US009988060B2

(12) United States Patent
Slurink

(10) Patent No.: US 9,988,060 B2
(45) Date of Patent: Jun. 5, 2018

(54) VEHICLE FOR A RAIL

(71) Applicant: Sluis Cigar Machinery B.V., Kampen (NL)

(72) Inventor: Oscar Slurink, Heino (NL)

(73) Assignee: Sluis Cigar Machinery B.V., Kampen (NL)

( * ) Notice: Subject to any disclaimer, the term of this patent is extended or adjusted under 35 U.S.C. 154(b) by 216 days.

(21) Appl. No.: 14/768,478

(22) PCT Filed: Feb. 18, 2014

(86) PCT No.: PCT/NL2014/050099
§ 371 (c)(1),
(2) Date: Aug. 18, 2015

(87) PCT Pub. No.: WO2014/129893
PCT Pub. Date: Aug. 28, 2014

(65) Prior Publication Data

US 2016/0052526 A1 Feb. 25, 2016

(30) Foreign Application Priority Data

Feb. 19, 2013 (NL) ..... 2010333
Jun. 24, 2013 (NL) ..... 2011030

(51) Int. Cl.
*B61B 3/00* (2006.01)
*B61B 13/04* (2006.01)
*B61D 15/00* (2006.01)

(52) U.S. Cl.
CPC ..... *B61B 3/00* (2013.01); *B61B 13/04* (2013.01); *B61D 15/00* (2013.01)

(58) Field of Classification Search
CPC .. B61B 13/04; B61B 3/00; B61B 5/00; B61D 15/00; B61C 13/04; E01B 25/10; E01B 25/22; B61F 9/00
(Continued)

(56) References Cited

U.S. PATENT DOCUMENTS 2,985,114 A * 5/1961 Lindner ..... B60B 17/0027 104/118
5,081,750 A 1/1992 Mölz
(Continued)

FOREIGN PATENT DOCUMENTS

DE 20302643 U1 5/2003
DE 10 2004 006 179 * 9/2004
(Continued)

*Primary Examiner* — Mark T Le
(74) *Attorney, Agent, or Firm* — Hoffmann & Baron, LLP

(57) ABSTRACT

A vehicle configured to be moved along a rail includes rollers which in use engage the rail such that each roller has a contact area with which the roller is in contact with the rail. The contact areas of the rollers are positioned to define a beam with a longitudinal beam axis, a rectangular form in a cross section perpendicular to the longitudinal beam axis and a first beam side, a second beam side, a third beam side and a fourth beam side, in which the first and third beam side extend perpendicular to the second and fourth beam side, at least two rollers define the first beam side, two rollers define the second beam side, one roller defines the third beam side, and one roller defines the fourth beam side. An assembly includes the vehicle and a rail.

11 Claims, 26 Drawing Sheets

(58) Field of Classification Search
USPC ..... 105/152, 30; 104/243, 89, 118, 119
See application file for complete search history.

(56) References Cited

U.S. PATENT DOCUMENTS

| | | | | |
|---|---|---|---|---|
| 5,222,439 | A | 6/1993 | Di Rosa | |
| 5,231,933 | A * | 8/1993 | DiRosa | B61C 13/04 104/93 |
| 6,047,645 | A * | 4/2000 | Cornwell | A63G 7/00 104/124 |
| 7,594,473 | B2 * | 9/2009 | Kitchen | A63G 7/00 104/53 |
| 2005/0263538 | A1 | 12/2005 | Boyl-Davis et al. | |

FOREIGN PATENT DOCUMENTS

| | | | |
|---|---|---|---|
| EP | 0354461 | A1 | 2/1990 |
| EP | 1642798 | A1 | 4/2006 |
| JP | S62-54060 | A | 3/1987 |
| JP | H2-48262 | A | 2/1990 |

* cited by examiner 20
22
22
22

VEHICLE FOR A RAIL

CROSS-REFERENCE TO RELATED APPLICATIONS

This application is the National Stage of International Application No. PCT/NL2014/050099 filed Feb. 18, 2014, which claims the benefit of Netherlands Application Nos. NL 2010333, filed Feb. 19, 2013, and NL 2011030, filed Jun. 24, 2013, the contents of all of which are incorporated by reference herein.

FIELD OF THE INVENTION

The invention relates to a vehicle configured to be moved along a rail and comprising rollers which in use engage the rail.

BACKGROUND OF THE INVENTION

A problem of the known vehicle is that the vehicle can not be moved along the rail without any clearance between the rail and the vehicle, especially in curved sections of the rail.

SUMMARY OF THE INVENTION

It is an object of the invention to provide an improved, or at least alternative, vehicle. This has been provided by a vehicle configured to be moved along a rail and comprising rollers which in use engage the rail such that each roller has a contact area with which said roller is in contact with the rail, wherein the contact areas of the rollers are positioned to define a beam with a longitudinal beam axis, a rectangular form in a cross section perpendicular to the longitudinal beam axis and a first beam side, a second beam side, a third beam side and a fourth beam side, in which the first and third beam side extend perpendicular to the second and fourth beam side, at least two rollers define the first beam side, two rollers define the second beam side, one roller defines the third beam side, and one roller defines the fourth beam side.

The configuration of the vehicle allows movement along the rail without any clearances between the vehicle and the rail. This results in an very accurate movement of the vehicle along the rail. When referring to an orthogonal coordinate system (x, y, z), the vehicle can be moved along the rail in the x-direction. The configuration of the assembly allows that the vehicle can be moved along sections of the rail which are curved in the y-direction or the z-direction without any clearance between the vehicle and the rail. This means that a vehicle is provided wherein the vehicle can be moved along the rail in three dimensions without any clearances between the vehicle and the rail.

In an embodiment of the vehicle, the vehicle comprises a maximum of three rollers defining the first beam side.

In an embodiment of the vehicle, the vehicle comprises exactly two rollers defining the first beam side. This means that two rollers, and not more than two rollers or less than two rollers, define the first beam side.

In an embodiment of the vehicle, two rollers define the first beam side, said rollers are formed by a first roller and a second roller, and the first roller has one contact area which, in a direction along the first beam side and perpendicular to the longitudinal beam axis, extends over a distance from a first location to a second location.

In an embodiment of the vehicle, the second roller is, in a direction along the first beam side and perpendicular to the longitudinal beam axis, located between the first location and second location.

In an embodiment of the vehicle, a two dimensional form is, in a view in a direction perpendicular to the first beam side, defined by the first location and second location of the first roller and the contact area of the second roller.

In an embodiment of the vehicle, two rollers define the first beam side, said rollers are formed by a first roller and a second roller, and the first roller has two contact areas which, in a direction along the first beam side and perpendicular to the longitudinal beam axis, are located at a distance from each other.

In an embodiment of the vehicle, the second roller is, in a direction along the first beam side and perpendicular to the longitudinal beam axis, located between the two contact areas of the first roller.

In an embodiment of the vehicle, a two dimensional form is, in a view in a direction perpendicular to the first beam side, defined by the three contact areas of the first roller and second roller.

In an embodiment of the vehicle, the vehicle comprises exactly three rollers defining the first beam side. This means that three rollers, and not more than three rollers or less than three rollers, define the first beam side.

In an embodiment of the vehicle, three rollers define the first beam side and, in a view in a direction perpendicular to the first beam side, a two dimensional form is defined by the contact areas of said three rollers.

In an embodiment of the vehicle, the three rollers are formed by a first roller, a second roller and a third roller, a straight line extending through the contact areas of the first roller and the third roller extends perpendicular to the longitudinal beam axis.

In an embodiment of the vehicle, the two-dimensional form is symmetric.

In an embodiment of the vehicle, the symmetric two-dimensional form has an axis of symmetry, and the longitudinal beam axis, in a view in a direction perpendicular to the first beam side, overlaps the axis of symmetry.

In an embodiment of the vehicle, the vehicle comprises exactly two rollers defining the second beam side. This means that two rollers, and not more than two rollers or less than two rollers, define the second beam side.

In an embodiment of the vehicle, the contact areas of the two rollers defining the second beam side are located at a distance from each other in the direction of the longitudinal beam axis.

In an embodiment of the vehicle, the vehicle comprises exactly one roller defining the third beam side. This means that one roller, and not more than one roller or less than one roller, defines the third beam side.

In an embodiment of the vehicle, the contact area of the roller defining the third beam side is, in a view in a direction perpendicular to the third beam side, located in the two dimensional form of the rollers defining the first beam side.

In an embodiment of the vehicle, the vehicle comprises exactly one roller defining the fourth beam side. This means that one roller, and not more than one roller or less than one roller, defines the first beam side.

In an embodiment of the vehicle, the contact area of the roller defining the fourth beam side is, in the direction of the longitudinal beam axis, located between the contact areas of the two rollers defining the second beam side.

In an embodiment of the vehicle, at least one of the rollers is formed by a rollable guiding ball.

In an embodiment of the vehicle, at least one of the rollers is formed by a guiding wheel rotatable around a wheel axis.

In an embodiment of the vehicle, at least six of the rollers defining the first beam side, the second beam side, the third beam side, and the fourth beam side are formed by guiding wheels, and the wheel axes of said guiding wheels do not coincide.

In an embodiment of the vehicle, all the rollers defining the first beam side, the second beam side, the third beam side, and the fourth beam side are formed by guiding wheels, and the wheel axes of said guiding wheels do not coincide.

In an embodiment of the vehicle, the rollers defining the first beam side are formed by guiding wheels and the wheel axes of said guiding wheels extend perpendicular to the second beam side and fourth beam side.

In an embodiment of the vehicle, the first roller is formed by a guiding wheel extending between the first location and second location.

In an embodiment of the vehicle, the first roller is formed by a guiding wheel extending between the two contact areas of the first roller.

In an embodiment of the vehicle, the two rollers defining the second beam side are formed by guiding wheels and the wheel axes of said guiding wheels extend perpendicular to the first beam side and third beam side.

In an embodiment of the vehicle, the roller defining the third beam side is formed by a guiding wheel and the wheel axis of said guiding wheel extends perpendicular to the second beam side and fourth beam side.

In an embodiment of the vehicle, the roller defining the fourth beam side is formed by a guiding wheel and the wheel axis of said guiding wheel extends perpendicular to the first beam side and third beam side.

In an embodiment of the vehicle, all the rollers are formed by a guiding wheel and the wheel axes of said guiding wheels extend parallel to the first beam side, second beam side, third beam side or fourth beam side defined by the respective guiding wheel.

In an embodiment of the vehicle, the guiding wheel comprises a contact surface forming the contact area and the contact surface has, in the direction of the wheel axis, an outwardly extending curve.

In an embodiment of the vehicle, the first roller is formed by a guiding wheel comprising a contact surface which, in the direction of the wheel axis, extends along a straight line between the first location and the second location.

In an embodiment of the vehicle, the first roller is formed by a guiding wheel comprising a contact surface which, in the direction of the wheel axis, has two outwardly extending curves which are located at a distance from each other and form the two contact areas.

In an embodiment of the vehicle, the rollers comprise a contact surface of a metallic material, such as steel, aluminium or titanium, or a ceramic material.

In an embodiment of the vehicle, two rollers define the first beam side, the vehicle comprises at least one further roller comprising a further contact area which in use is in contact with a further rail, and the further contact area is located at a distance from the beam. This is advantageous to prevent that the vehicle rotates about the longitudinal beam axis.

In an embodiment of the vehicle, the at least one further roller in use prevents rotation of the vehicle about the longitudinal beam axis by its contact with the further rail.

In an embodiment of the vehicle, each of the at least one further roller is positioned to in use be in contact with a surface of the further rail.

In an embodiment of the vehicle, for each of the at least one further roller, the surface of the further rail with which it in use is in contact extends parallel to the longitudinal beam axis.

In an embodiment of the vehicle, for each of the at least one further roller, the surface of the further rail with which it is in contact extends parallel to the first beam side and third beam side.

In an embodiment of the vehicle, at least one of the at least one further roller is formed by a rollable guiding ball.

In an embodiment of the vehicle, at least one of the at least one further roller is formed by a guiding wheel rotatable around a wheel axis.

In an embodiment of the vehicle, for each guiding wheel, the wheel axis extends perpendicular to the first beam side and the third beam side, or to the second beam side and the fourth beam side.

In an embodiment of the vehicle, the at least one further roller has a first further roller and a second further roller, the first further roller is in use in contact with a first surface of the further rail, and the second further roller is in use in contact with a second surface of the further rail.

In an embodiment of the vehicle, in use the first further roller and second further roller rotate in opposite direction.

In an embodiment of the vehicle, the first further roller and second further roller are formed by guiding wheels and the wheel axes of said guiding wheels extend parallel to each other.

In an embodiment of the vehicle, the wheel axes of the first further roller and second further roller extend perpendicular to the second beam side and fourth beam side.

In an embodiment of the vehicle, the wheel axes of the first further roller and second further roller extend parallel to the first beam side and third beam side.

In an embodiment of the vehicle, the at least one further roller has a first further roller, the first further roller is in use in contact with a first surface of the further rail or a second surface of the further rail.

In an embodiment of the vehicle, the first further roller is formed by a guiding wheel and the wheel axes of said guiding wheel extends parallel to the first beam side and third beam side.

In an embodiment of the vehicle, the first further roller is formed by a guiding wheel and the wheel axes of said guiding wheel extends parallel to the first beam side and third beam side.

In an embodiment of the vehicle, the first surface and the second surface of the further rail extend parallel to each other.

In an embodiment of the vehicle, the distance between the further contact area of each of the at least one further roller and the longitudinal beam axis is between 3, 5 and 15 times, preferably between 5 and 10 times, the distance between the first beam side and third beam side.

In an embodiment of the vehicle, the distance between the further contact area of each of the at least one further roller and the longitudinal beam axis is between 3, 5 and 15 times, preferably between 5 and 10 times, the distance between the second beam side and fourth beam side.

In an embodiment of the vehicle, the further rail extends parallel to the beam.

In an embodiment of the vehicle, the vehicle is free from a further roller. This means that the vehicle does not have a further roller.

In an embodiment of the vehicle, the vehicle is free from a further roller as defined in any of the clauses 36-55. This means that the vehicle does not have a further roller as defined in any of the clauses 36-55.

The invention further relates to an assembly comprising a rail having a longitudinal rail axis, a rectangular form in a cross section perpendicular to the longitudinal rail axis and a first rail side, a second rail side, a third rail side and a fourth rail side, in which the first and third rail side extend perpendicular to the second and fourth rail side, a vehicle configured to be moved along the rail and comprising rollers which in use engage the rail such that each roller has a contact area with which said roller is in contact with the rail, wherein at least two rollers are in contact with the first rail side, two rollers are in contact with the second rail side, one roller is in contact with the third rail side, and one roller is in contact with the fourth rail side.

In an embodiment of the assembly, the vehicle comprises a maximum of three rollers being in contact with the first rail side.

In an embodiment of the assembly, the vehicle comprises exactly two rollers being in contact with the first rail side. This means that two rollers, and not more than two rollers or less than two rollers, are in contact with the first rail side.

In an embodiment of the assembly, two rollers are in contact with the first rail side, said rollers are formed by a first roller and a second roller, and the first roller has one contact area which, in a direction along the first rail side and perpendicular to the longitudinal rail axis, extends over a distance from a first location to a second location.

In an embodiment of the assembly, the second roller is, a direction along the first rail side and perpendicular to the longitudinal rail axis, located between the first location and second location.

In an embodiment of the assembly, a two dimensional form is defined, in a view in a direction perpendicular to the first rail side, by the first location and second location of the first roller and the contact area of the second roller.

In an embodiment of the assembly, two rollers are in contact with the first rail side, said rollers are formed by a first roller and a second roller, and the first roller has two contact areas which, in a direction along the first rail side and perpendicular to the longitudinal rail axis, are located at a distance from each other.

In an embodiment of the assembly, the second roller is, in a direction along the first rail side and perpendicular to the longitudinal rail axis, located between the two contact areas of the first roller.

In an embodiment of the assembly, a two dimensional form is defined, in a view in a direction perpendicular to the first rail side, by the three contact areas of the first roller and second roller.

In an embodiment of the assembly, the vehicle comprises exactly three rollers being in contact with the first rail side. This means that three rollers, and not more than three rollers or less than three rollers, are in contact with the first rail side.

In an embodiment of the assembly, three rollers are in contact with the first rail side and, in a view in a direction perpendicular to the first rail side, a two dimensional form is defined by the contact areas of said three rollers.

In an embodiment of the assembly, the three rollers are formed by a first roller, a second roller and a third roller, a straight line extending through the contact areas of the first roller and the third roller extends perpendicular to the longitudinal rail axis.

In an embodiment of the assembly, the two-dimensional form is symmetric.

In an embodiment of the assembly, the symmetric two-dimensional form has an axis of symmetry, and the longitudinal rail axis, in a view in a direction perpendicular to the first rail side, overlaps the axis of symmetry.

In an embodiment of the assembly, the vehicle comprises exactly two rollers being in contact with the second rail side. This means that two rollers, and not more than two rollers or less than two rollers, are in contact with the second rail side.

In an embodiment of the assembly, the two rollers being in contact with the second rail side are located at a distance from each other in the direction of the longitudinal rail axis.

In an embodiment of the assembly, the vehicle comprises exactly one roller being in contact with the third rail side. This means that one roller, and not more than one roller or less than one roller, is in contact with the third rail side.

In an embodiment of the assembly, the roller being in contact with the third rail side is, in a view in a direction perpendicular to the third rail side, located in the two dimensional form defined by the rollers in contact with the first rail side.

In an embodiment of the assembly, the vehicle comprises exactly one roller being in contact with the fourth rail side. This means that one roller, and not more than one roller or less than one roller, is in contact with the fourth rail side.

In an embodiment of the assembly, the contact area of the roller being in contact with the fourth rail side is, in the direction of the longitudinal rail axis, located between the contact areas of the two rollers being in contact with the second rail side.

In an embodiment of the assembly, at least one of the rollers is formed by a rollable guiding ball.

In an embodiment of the assembly, at least one of the rollers is formed by a guiding wheel rotatable around a wheel axis.

In an embodiment of the assembly, at least six of the rollers being in contact with the first rail side, the second rail side, the third rail side, and the fourth rail side are formed by guiding wheels, and the wheel axes of said guiding wheels do not coincide.

In an embodiment of the assembly, all of the rollers defining the first rail side, the second rail side, the third rail side, and the fourth rail side are formed by guiding wheels, and the wheel axes of said guiding wheels do not coincide.

In an embodiment of the assembly, the rollers being in contact with the first rail side are formed by guiding wheels and the wheel axes of said guiding wheels extend perpendicular to the second rail side and fourth rail side.

In an embodiment of the assembly, the first roller is formed by a guiding wheel extending between the first location and second location.

In an embodiment of the assembly, the first roller is formed by a guiding wheel extending between the two contact areas of the first roller.

In an embodiment of the assembly, the two rollers being in contact with the second rail side are formed by guiding wheels and the wheel axes of said guiding wheels extend perpendicular to the first rail side and third rail side.

In an embodiment of the assembly, the roller being in contact with the third rail side is formed by a guiding wheel and the wheel axis of said guiding wheel extends perpendicular to the second rail side and fourth rail side.

In an embodiment of the assembly, the roller being in contact with the fourth rail side is formed by a guiding wheel and the wheel axis of said guiding wheel extends perpendicular to the first rail side and third rail side.

In an embodiment of the assembly, all the rollers are formed by a guiding wheel and the wheel axes of said guiding wheels extend parallel to the first rail side, second rail side, third rail side or fourth rail side in contact with the respective guiding wheel.

In an embodiment of the assembly, the guiding wheel comprises a contact surface forming the contact area and the contact surface has, in the direction of the wheel axis, an outwardly extending curve.

In an embodiment of the assembly, the first roller is formed by a guiding wheel comprising a contact surface which, in the direction of the wheel axis, extends along a straight line between the first location and the second location.

In an embodiment of the assembly, the first roller is formed by a guiding wheel comprising a contact surface which, in the direction of the wheel axis, has two outwardly extending curves which are located at a distance from each other and form the two contact areas.

In an embodiment of the assembly, the rail is made of a metallic material, such as steel, aluminium or titanium.

In an embodiment of the assembly, the vehicle comprises at least one further roller comprising a further contact area which is in contact with a further rail, and the further contact area is located at a distance from the rail. This is advantageous to prevent that the vehicle rotates about the longitudinal rail axis.

In an embodiment of the assembly, the at least one further roller prevents rotation of the vehicle about the longitudinal rail axis by its contact with the further rail.

In an embodiment of the assembly, each of the at least one further roller is in contact with a surface of the further rail.

In an embodiment of the assembly, for each of the at least one further roller, the surface of the further rail with which it is in contact extends parallel to the longitudinal rail axis.

In an embodiment of the assembly, for each of the at least one further roller, the surface of the further rail with which it is in contact extends parallel to the first rail side and third rail side.

In an embodiment of the assembly, at least one of the at least one further roller is formed by a rollable guiding ball.

In an embodiment of the assembly, at least one of the at least one further roller is formed by a guiding wheel rotatable around a wheel axis.

In an embodiment of the assembly, for each guiding wheel, the wheel axis extends perpendicular to the first rail side and the third rail side, or to the second rail side and the fourth rail side.

In an embodiment of the assembly, the at least one further roller has a first further roller and a second further roller, the first further roller is in contact with a first surface of the further rail, and the second further roller is in contact with a second surface of the further rail.

In an embodiment of the assembly, in use the first further roller and second further roller rotate in opposite direction.

In an embodiment of the assembly, the first further roller and second further roller are formed by guiding wheels and the wheel axes of said guiding wheels extend parallel to each other.

In an embodiment of the assembly, the wheel axes of the first further roller and second further roller extend perpendicular to the second rail side and fourth rail side.

In an embodiment of the assembly, the wheel axes of the first further roller and second further roller extend parallel to the first rail side and third rail side.

In an embodiment of the assembly, the at least one further roller has a first further roller, the first further roller is in contact with a first surface of the further rail or a second surface of the further rail.

In an embodiment of the assembly, wherein the first further roller is formed by a guiding wheel and the wheel axis of said guiding wheel extends perpendicular to the second rail side and fourth rail side.

In an embodiment of the assembly, wherein the first further roller is formed by a guiding wheel and the wheel axes of said guiding wheel extends parallel to the first rail side and third rail side.

In an embodiment of the assembly, the first surface and the second surface of the further rail extend parallel to each other.

In an embodiment of the assembly, the distance between the further contact area of each of the at least one further roller and the longitudinal rail axis is between 3, 5 and 15 times, preferably between 5 and 10 times, the distance between the first rail side and third rail side.

In an embodiment of the assembly, the distance between the further contact area of each of the at least one further roller and the longitudinal rail axis is between 3, 5 and 15 times, preferably between 5 and 10 times, the distance between the second beam side and fourth beam side.

In an embodiment of the assembly, the further rail extends parallel to the rail.

In an embodiment of the assembly, the rollers are made of metallic material, such as steel, aluminium or titanium, or a ceramic material.

In an embodiment of the assembly, the assembly is free from a further roller and free from a further rail. This means that the assembly does not have a further roller and a further rail.

In an embodiment of the assembly, the assembly is free from a further roller and further rail as defined in any of the clauses 57, 96-115. This means that the assembly does not have a further roller and a further rail as defined in any of the clauses 57, 96-115.

BRIEF DESCRIPTION OF THE DRAWINGS

Embodiments of the vehicle and assembly will be described by way of example only, with reference to the accompanying schematic drawings in which corresponding reference symbols indicate corresponding parts, and in which:

the FIGS. 1 and 2 schematically show a view in perspective of an embodiment of the vehicle according to the invention, FIG. 3 schematically shows a view in perspective of an embodiment of the assembly according to the invention and comprising the vehicle of FIG. 1, the FIGS. 4 and 5 schematically show a view in perspective of a further embodiment of the vehicle according to the invention, FIG. 6 schematically shows a view in perspective of a further embodiment of the assembly according to the invention and comprising the vehicle of FIG. 4, the FIGS. 7 and 8 schematically show a view in perspective of a further embodiment of the vehicle according to the invention, FIG. 9 schematically shows a view in perspective of a further embodiment of the assembly according to the invention and comprising the vehicle of FIG. 7, FIG. 10 schematically shows a side view in the direction of arrow X of FIG. 1, FIG. 11 schematically shows a side view in the direction of arrow XI of FIG. 1, FIG. 12 schematically shows a top view in the direction of arrow XII of FIG. 1, the FIGS. 13 and 14 schematically shown the vehicle of FIG. 1 in a curved section of the rail, FIG. 15 schematically shows a view of an embodiment of the rail in cross section perpendicular to the longitudinal real axis, FIG. 16 schematically shows a view of an embodiment of the rail of the assembly of FIG. 9 in cross section perpendicular to the longitudinal real axis, FIG. 17 schematically shows a view in perspective of an embodiment of the guiding wheel forming the rollers of the vehicles of FIG. 1, FIG. 18 schematically shows a view in perspective of a first embodiment of the guiding wheel forming the first roller of the vehicle of FIG. 4, FIG. 19 schematically shows a view in perspective of a second embodiment of the guiding wheel forming the first roller of the vehicle of FIG. 4, the FIGS. 20 and 21 schematically show a view in perspective of a further embodiment of the vehicle according to the invention, FIG. 22 schematically shows a view in perspective of a further embodiment of the assembly according to the invention and comprising the vehicle of FIG. 20, FIG. 23 schematically shows a side view in the direction of arrow XXIII of FIG. 20, FIG. 24 schematically shows a side view in the direction of arrow XXIV of FIG. 20, FIG. 25 schematically shows a top view in the direction of arrow XV of FIG. 20, and FIG. 26 schematically shows a view in perspective of a further embodiment of the assembly according to the invention.

DETAILED DESCRIPTION OF THE INVENTION

Figure 1:
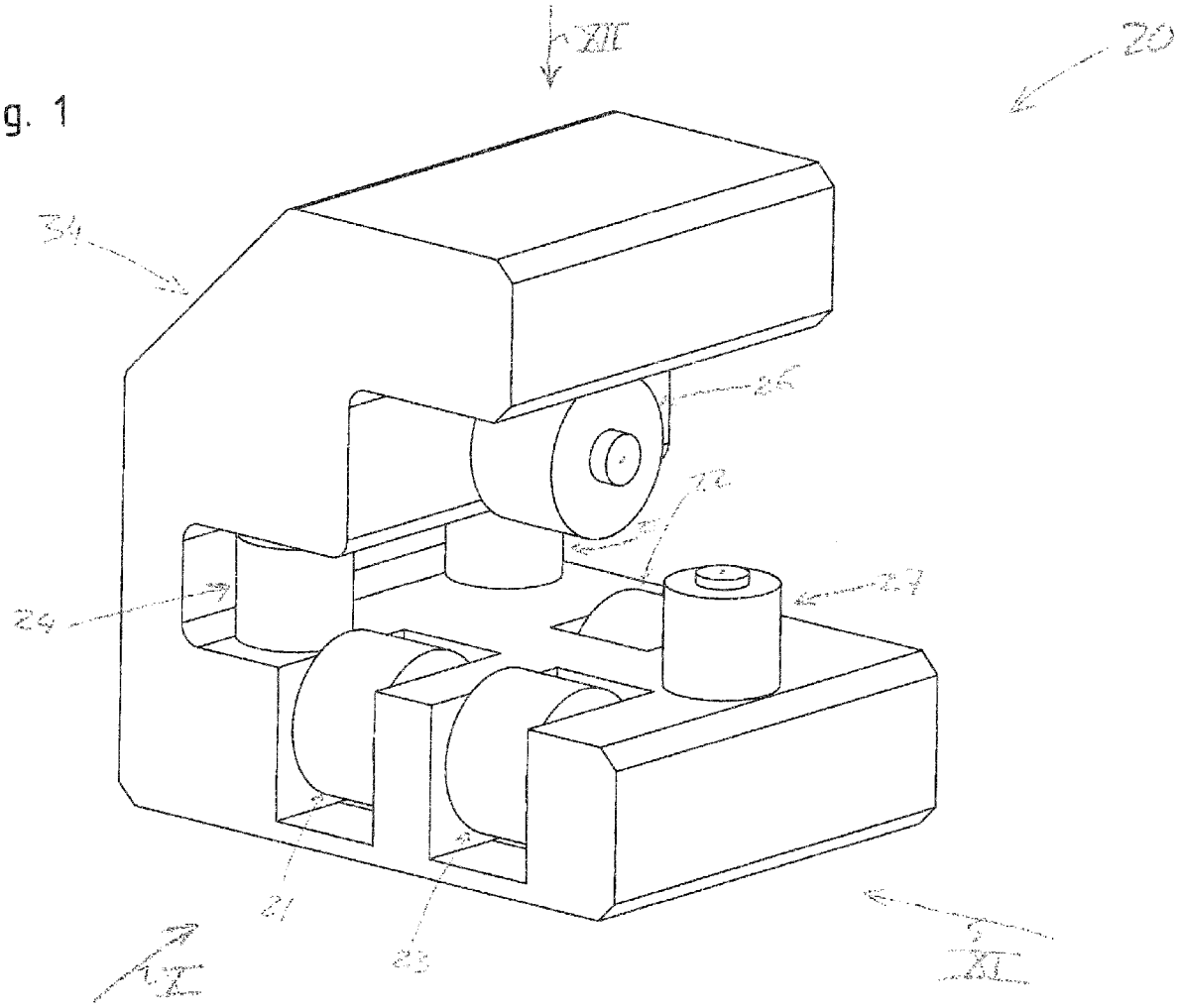
Figure 2:
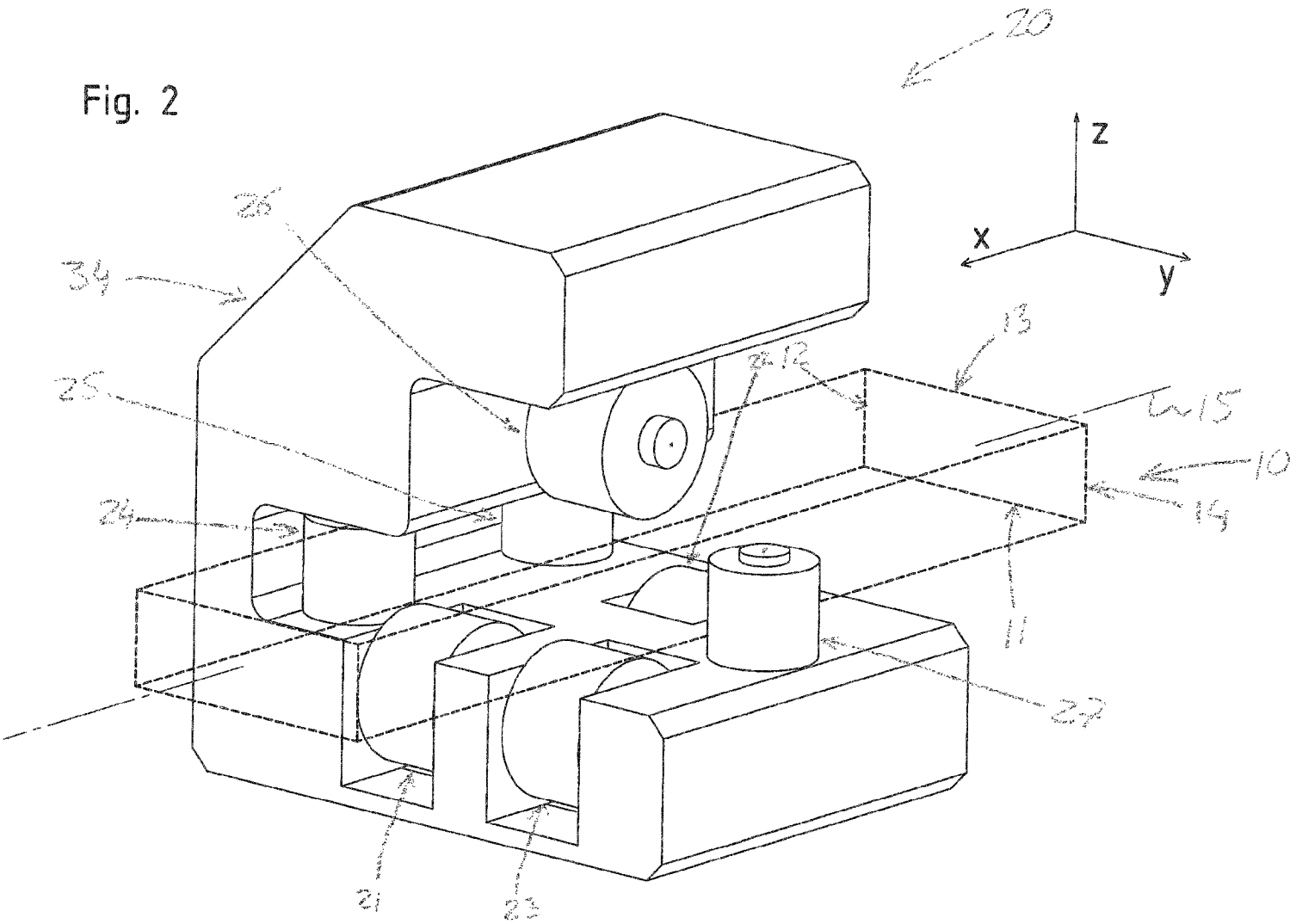

The FIGS. 1 and 2 show an embodiment of the vehicle 20 according to the invention. The vehicle 20 is configured to be moved along a rail 40 and comprises rollers 21-27 which in use engage the rail 40 such that each roller 21-27 has a contact area 28 with which said roller 21-27 is in contact with the rail 40. The vehicle 20 comprises a base construction 34. The rollers 21-27 are connected to the base construction 34. The contact areas 28 of the rollers 21-27 are positioned to define a beam 10 with a longitudinal beam axis 15 and a rectangular form 2 in a cross section perpendicular to the longitudinal beam axis 15. The beam 10 has a first beam side 11, a second beam side 12, a third beam side 13 and a fourth beam side 14. The first and third beam side 11, 13 extend perpendicular to the second and fourth beam side 12, 14. Three rollers (a first roller 21, second roller 22, and third roller 23) define the first beam side 11. Two rollers (a fourth roller 24, and fifth roller 25) define the second beam side 12. One roller (a sixth roller 26) defines the third beam side 13. One roller (a seventh roller 27) defines the fourth beam side 14. The beam 10 has a constant cross section and a straight longitudinal beam axis 15.

An orthogonal coordinate system indicating the dimensions x, y, z is shown in FIG. 2. The configuration of the vehicle 20 allows a movement along the rail 10 without any clearance between the vehicle 20 and the rail 10. This results in an very accurate movement of the vehicle 20.

Figure 10:
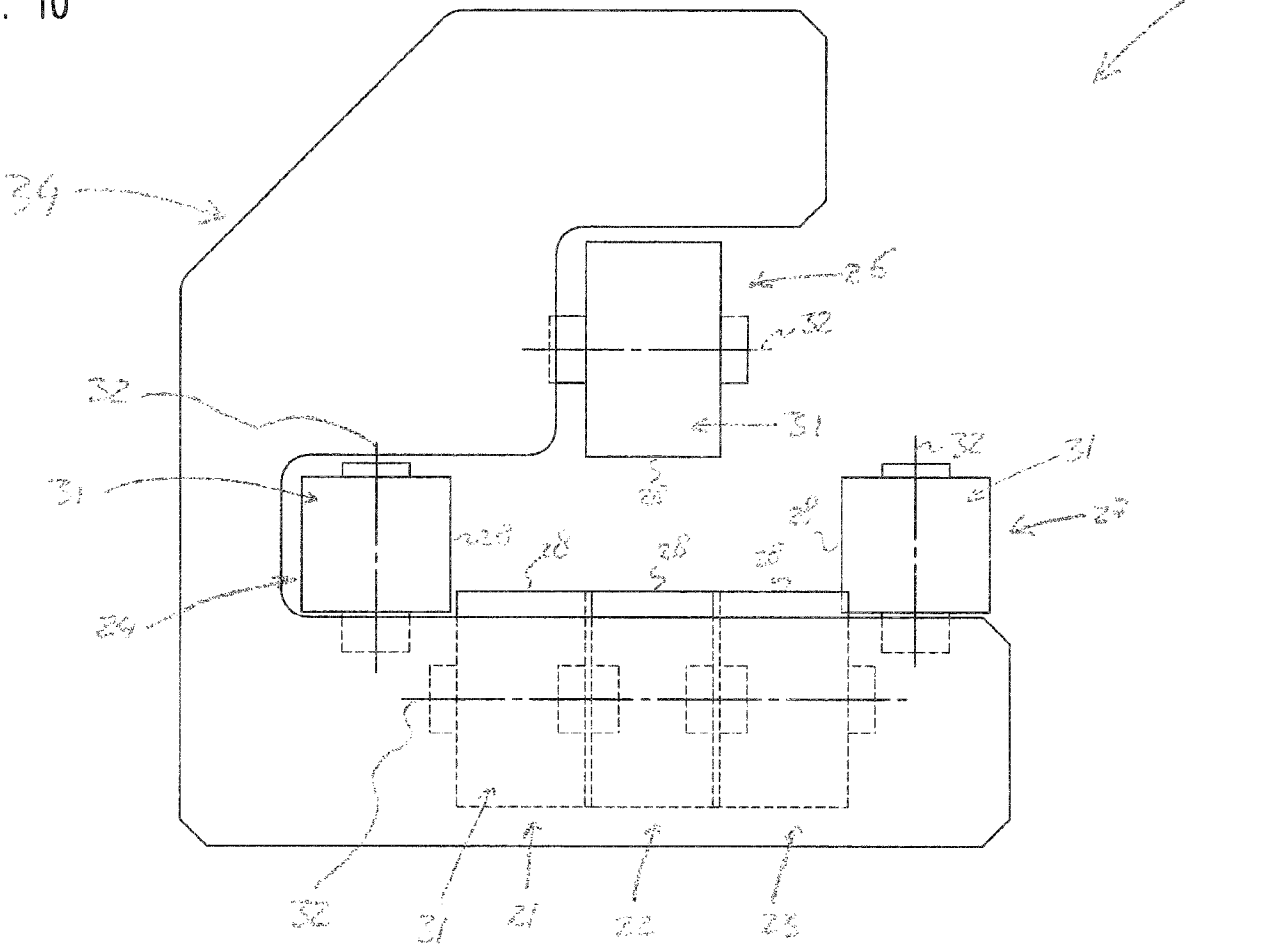
Figure 11:
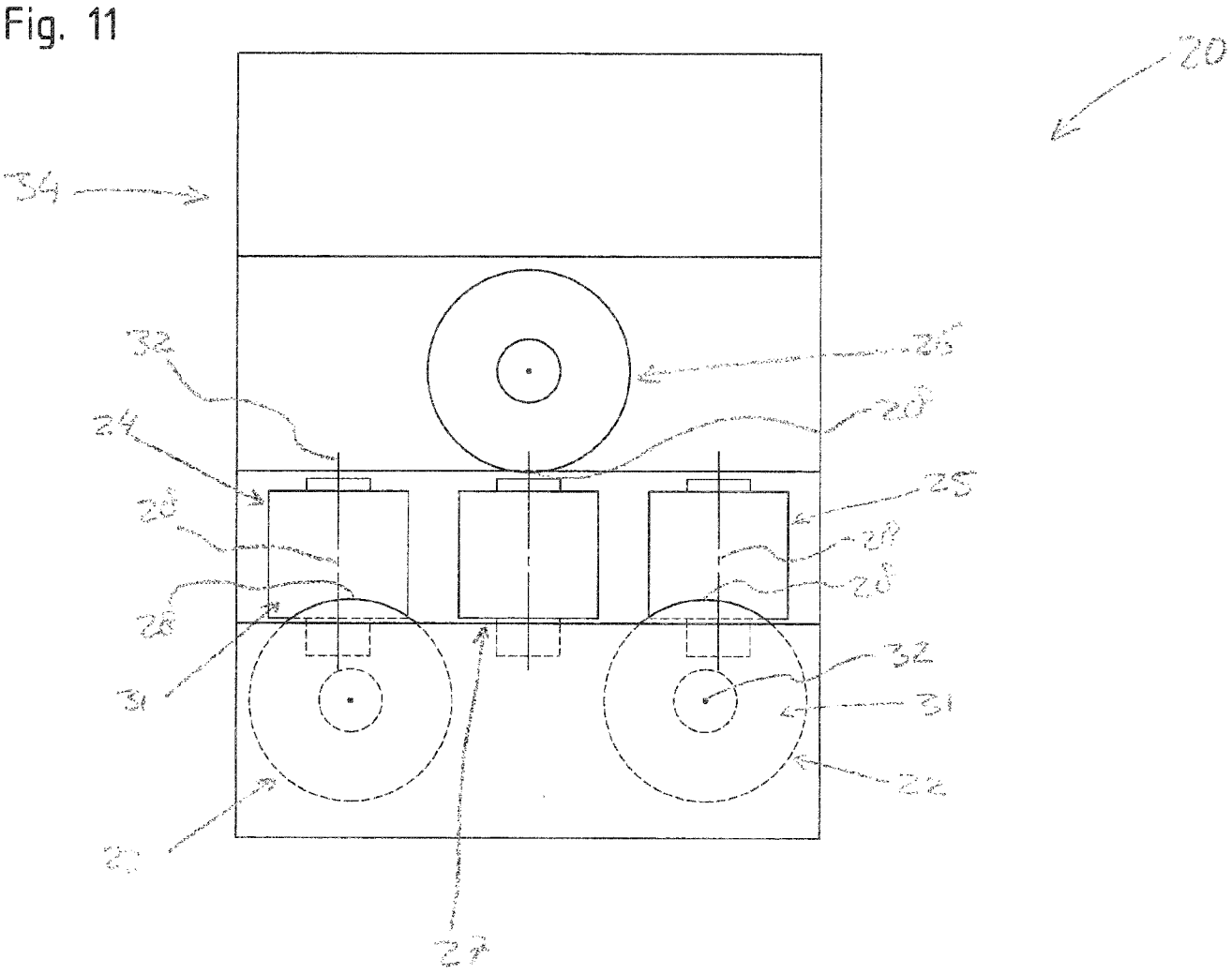
Figure 12:
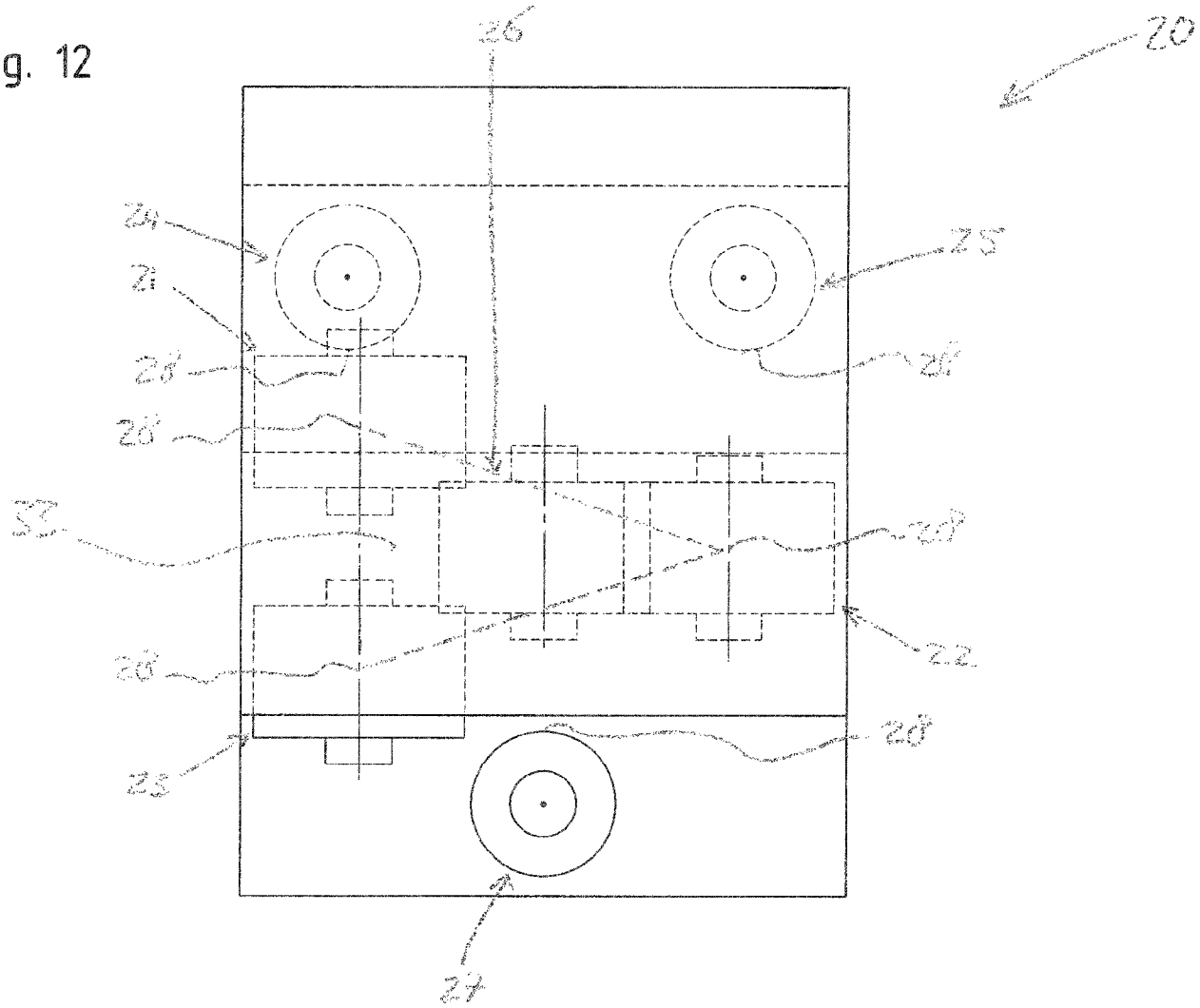

Further details of the vehicle 20 of FIGS. 1 and 2 are shown the FIG. 10-12 showing several views of said vehicle 20.

Each roller 21-27 has a contact surface 29 which is configured such that the roller 21-27 has a small contact area 28 with which it in use is in contact with the respective first, second, third or fourth 11-14 side of the rail 40.

In a view in a direction perpendicular to the first beam side 11, a two dimensional form 33 is defined by the contact areas 28 of the three rollers 21-23 defining the first beam side 11 of the beam 10. A straight line extending through the contact areas 28 of the first roller 21 and the third roller 23 extends perpendicular to the longitudinal beam axis 15. The two-dimensional form 33 is symmetric. The symmetric two-dimensional form 33 has an axis of symmetry, and the longitudinal beam axis 15, in a view in a direction perpendicular to the first beam side 11, overlaps the axis of symmetry. Due the fact that the contact areas 28 of the rollers 21-23 are small, the two dimensional form 33 has a triangle-like form. The triangle-like form may be like an equilateral triangle or an isosceles triangle.

The contact areas 28 of the two rollers 24, 25 defining the second beam side 12 are located at a distance from each other in the direction of the longitudinal beam axis 15.

The contact area 28 of the roller 26 defining the third beam side 13 is, in a view in a direction perpendicular to the third beam side 13, located in the two dimensional form 33 of the rollers 21-23 defining the first beam side 11.

The contact area 28 of the roller 27 defining the fourth beam side 14 is, in the direction of the longitudinal beam axis 15, located between the contact areas 28 of the two rollers 24, 25 defining the second beam side 12.

The rollers 21-23 defining the first beam side 11 are formed by guiding wheels 31 and the wheel axes 32 of said guiding wheels 31 extend perpendicular to the second beam side 12 and fourth beam side 14.

The two rollers 24, 25 defining the second beam side 12 are formed by guiding wheels 31 and the wheel axes 32 of said guiding wheels 31 extend perpendicular to the first beam side 11 and third beam side 13.

The roller 26 defining the third beam side 13 is formed by a guiding wheel 31 and the wheel axis 32 of said guiding wheel 31 extends perpendicular to the second beam side 12 and fourth beam side 14.

The roller 27 defining the fourth beam side 14 is formed by a guiding wheel 31 and the wheel axis 32 of said guiding wheel 31 extends perpendicular to the first beam side 11 and third beam side 13.

Figure 3:
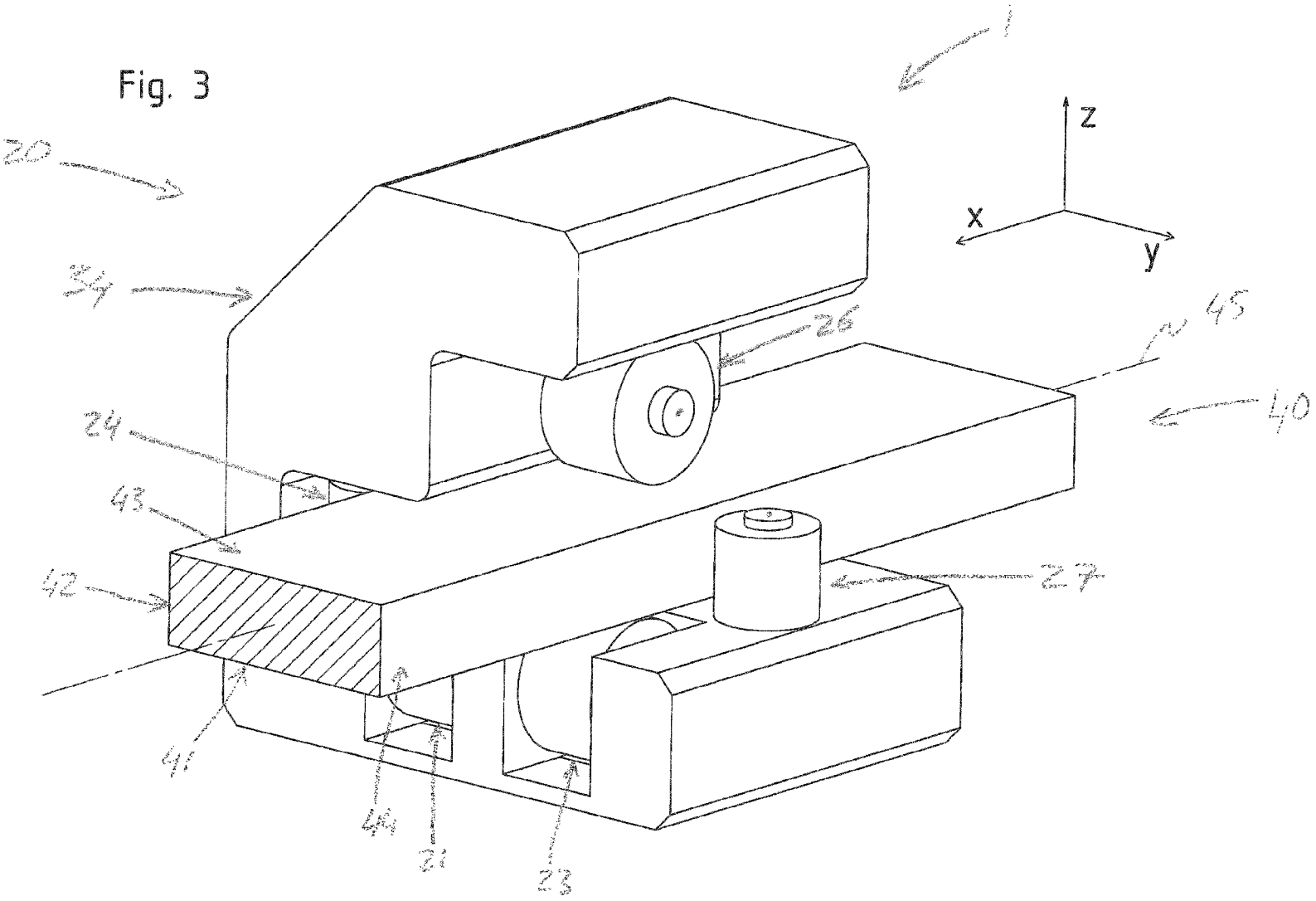

FIG. 3 shows an assembly of the vehicle 20 of FIG. 1 and a rail 40. The rail 40 has a rectangular form 2 in a cross section perpendicular to the longitudinal rail axis 45 and a first rail side 41, a second rail side 42, a third rail side 43 and a fourth rail side 44. The first and third rail 41, 43 side extend perpendicular to the second and fourth rail side 42, 44. Three rollers (a first roller 21, second roller 22, and third roller 23) are in contact with the first rail side 41. Two rollers (a fourth roller 24, and fifth roller 25) are in contact with the second rail side 42. One roller (a sixth roller 26) is in contact with the third rail side 43. One roller (a seventh roller 27) is in contact with the fourth rail side 44. The rail 40 and a vehicle 20 are movable relative to each other along the longitudinal rail axis 45 of the rail 40. Only a part of the rail 40 is shown. The shown rail 40 has a constant cross section and a straight longitudinal rail axis 45.

The vehicle 20 can be moved along the rail 40 in the direction of the longitudinal rail axis 45. In the situation shown in FIG. 3, this corresponds to the x-direction. The configuration of the assembly 1 allows that the vehicle 20 can be moved along sections of the rail 40 which are curved in the y-direction or the z-direction without any clearance between the vehicle 20 and the rail 40. This means that an assembly 1 is provided wherein the vehicle 20 can be moved along the rail 40 in three dimensions without any clearance between the vehicle 20 and the rail 40.

In a view in a direction perpendicular to the first rail side 41, a two dimensional form 33 is defined by the contact areas 28 of the three rollers 21-23 being in contact with the first rail side 41.

A straight line extending through the contact areas 28 of the first roller 21 and the third roller 23 extends perpendicular to the longitudinal real axis 45. The two-dimensional form 33 is symmetric. The symmetric two-dimensional form 33 has an axis of symmetry, and the longitudinal rail axis 45, in a view in a direction perpendicular to the first rail side 41, overlaps the axis of symmetry. Due the fact that the contact areas 28 of the rollers 21-23 are small, the two dimensional form 33 has a triangle-like form. The triangle-like form may be like an equilateral triangle or an isosceles triangle.

The two rollers 24, 25 being in contact with the second rail side 42 are located at a distance from each other in the direction of the longitudinal rail axis 45.

The roller 26 being in contact with the third rail side 43 is, in a view in a direction perpendicular to the third rail side 43, located in the two dimensional form 33 defined by the rollers 21-23 in contact with the first rail side 41.

The contact area 28 of the roller 27 being in contact with the fourth rail side 44 is, in the direction of the longitudinal rail axis 45, located between the contact areas 28 of the two rollers 24, 25 being in contact with the second rail side 42.

The rollers 21-23 being in contact with the first rail side 41 are formed by guiding wheels 31 and the wheel axes 32 of said guiding wheels 31 extend perpendicular to the second rail side 42 and fourth rail side 44.

The two rollers 24, 25 being in contact with the second rail side 42 are formed by guiding wheels 31 and the wheel axes 32 of said guiding wheels 31 extend perpendicular to the first rail side 41 and third rail side 43.

The roller 26 being in contact with the third rail side 43 is formed by a guiding wheel 31 and the wheel axis 32 of said guiding wheel 31 extends perpendicular to the second rail side 42 and fourth rail side 44.

The roller 27 being in contact with the fourth rail side 44 is formed by a guiding wheel 31 and the wheel axis 32 of said guiding wheel 31 extends perpendicular to the first rail side 41 and third rail side 43.

Figure 4:
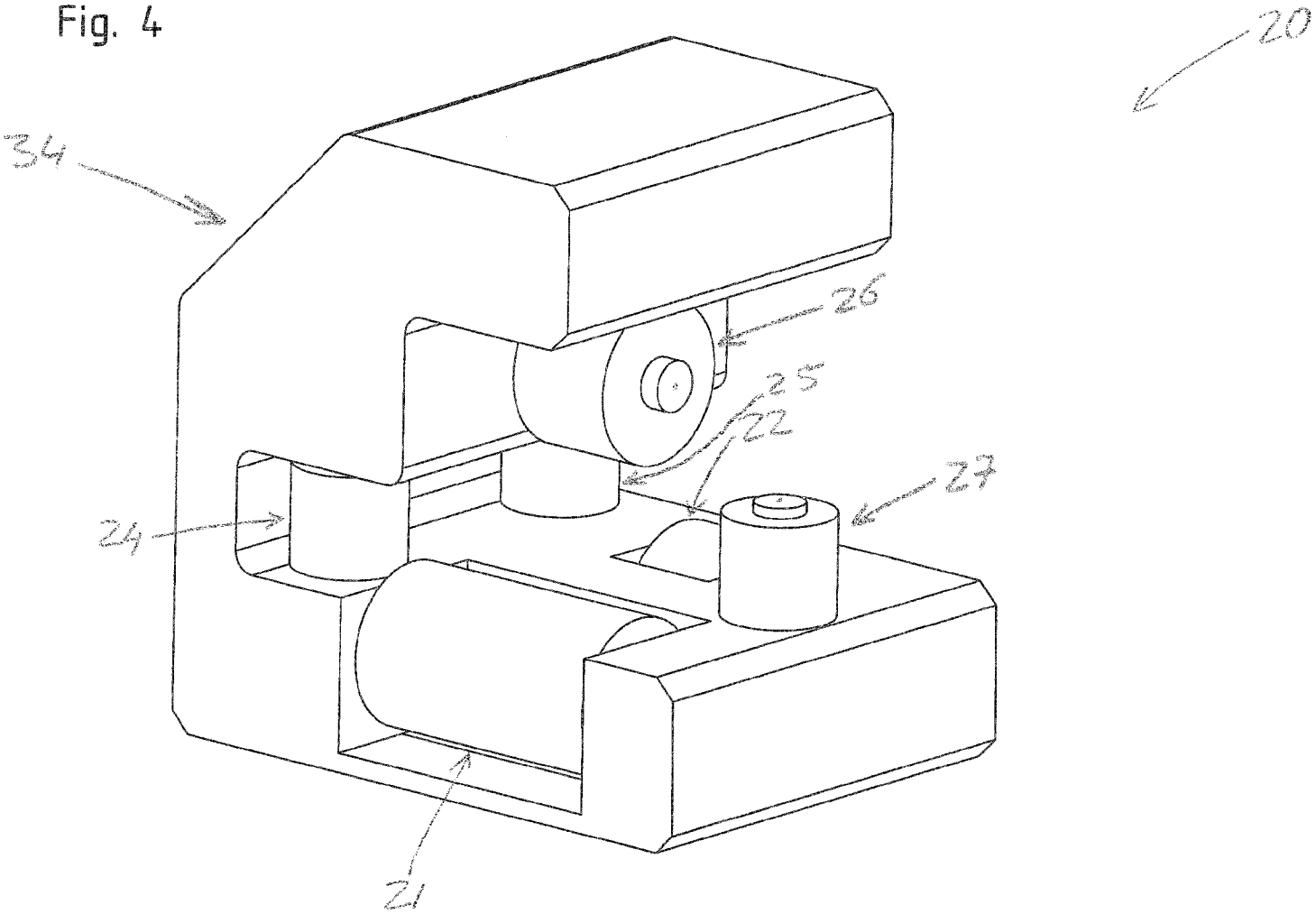
Figure 5:
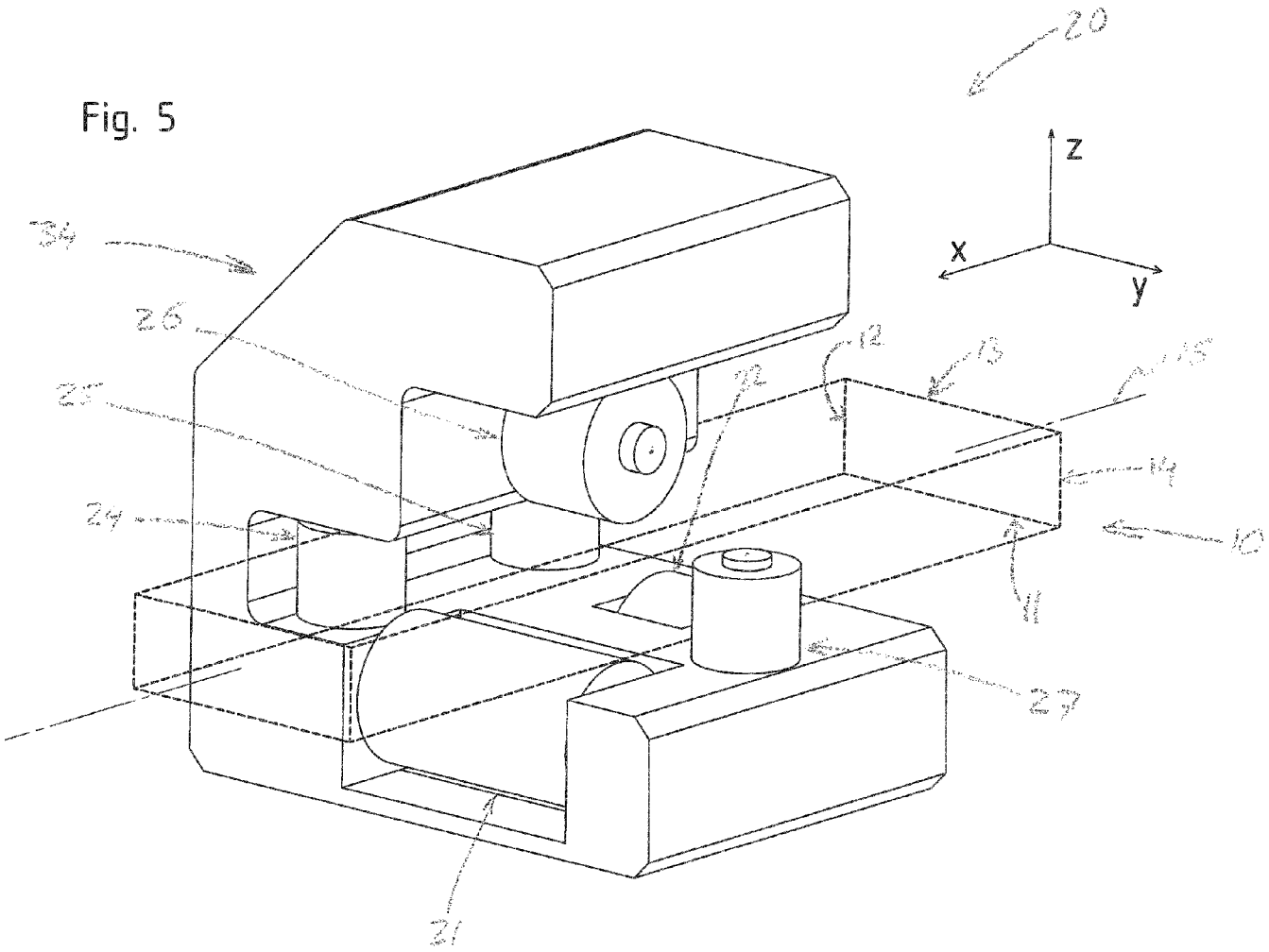

The FIGS. 4 and 5 show a further embodiment of the vehicle 20 according to the invention. The vehicle 20 differs from the one shown in FIGS. 1 and 2, in that the vehicle 20 has two rollers 21, 22 which define the first beam side 11 in stead of three rollers. Said two rollers 21, 22 are formed by a first roller 21 and a second roller 22. Two rollers (a fourth roller 24, and fifth roller 25) define the second beam side 12. One roller (a sixth roller 26) defines the third beam side 13. One roller (a seventh roller 27) defines the fourth beam side 14.

In a first embodiment, the first roller 21 has one contact area 28 which, in a direction along the first beam side 11 and perpendicular to the longitudinal beam axis 15, extends over a distance from a first location 35 to a second location 36.

Figure 18:
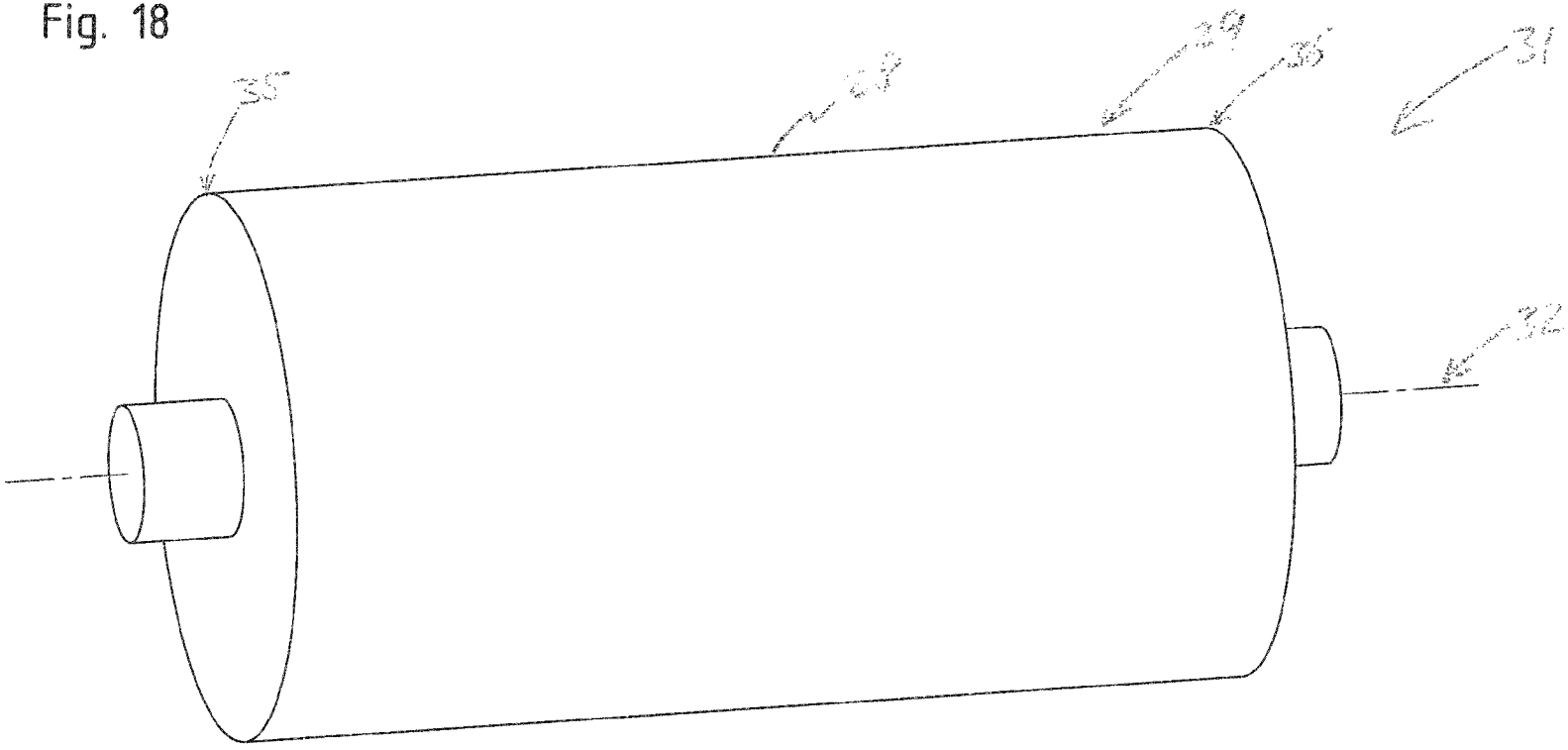

An example of a roller which can be used for said first roller 21 is shown in FIG. 18. The first roller 21 is formed by a guiding wheel 31 extending between the first location 35 and second location 36.

The contact area 28 of the second roller 22 is, in a direction along the first beam side 11 and perpendicular to the longitudinal beam axis 15, located between the first location 35 and second location 36.

In a view in a direction perpendicular to the first beam side 11, a two dimensional form 33 is defined by the first location 35 and second location 36 of the first roller 21 and the contact area 28 of the second roller 22. A straight line extending through the first and second location 35, 36 of the first roller 21 of the second roller 22 extends perpendicular to the longitudinal rail axis 45. The two-dimensional form 33 is symmetric. The symmetric two-dimensional form 33 has an axis of symmetry, and the longitudinal rail axis 45, in a view in a direction perpendicular to the first beam side 11, overlaps the axis of symmetry. The two dimensional form 33 has a triangle-like form. The triangle-like form may be like an equilateral triangle or an isosceles triangle.

In a second embodiment, the first roller 21 has two contact areas 28 which, in a direction along the first beam side 11 and perpendicular to the longitudinal beam axis 15, are located at a distance from each other.

Figure 19:
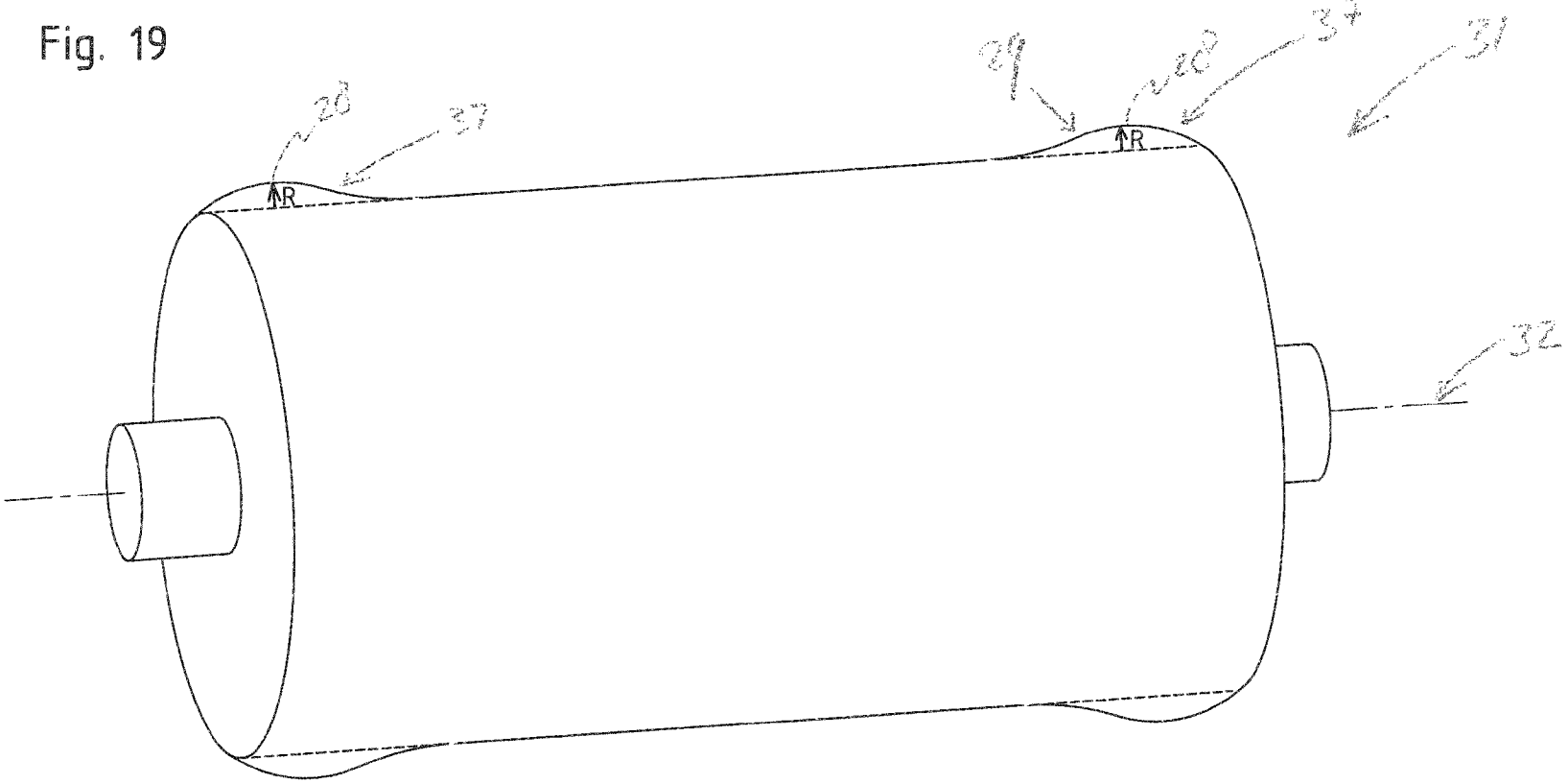

An example of a roller which can be used for said first roller 21 is shown in FIG. 19. The first roller 21 is formed by a guiding wheel 31 extending between the two contact areas 28 of the first roller 21.

The contact area 28 of the second roller 22 is, in a direction along the first beam side 11 and perpendicular to the longitudinal beam axis 15, located between the two contact areas 28 of the first roller 21. In a view in a direction perpendicular to the first beam side 11, a two dimensional form 33 is defined by the three contact areas 28 of the first roller 21 and second roller 22.

A straight line extending through the two contact areas of the first roller 21 extends perpendicular to the longitudinal beam axis 15. The two-dimensional form 33 is symmetric. The symmetric two-dimensional form 33 has an axis of symmetry, and the longitudinal beam axis 15, in a view in a direction perpendicular to the first beam side 11, overlaps the axis of symmetry.

Figure 6:
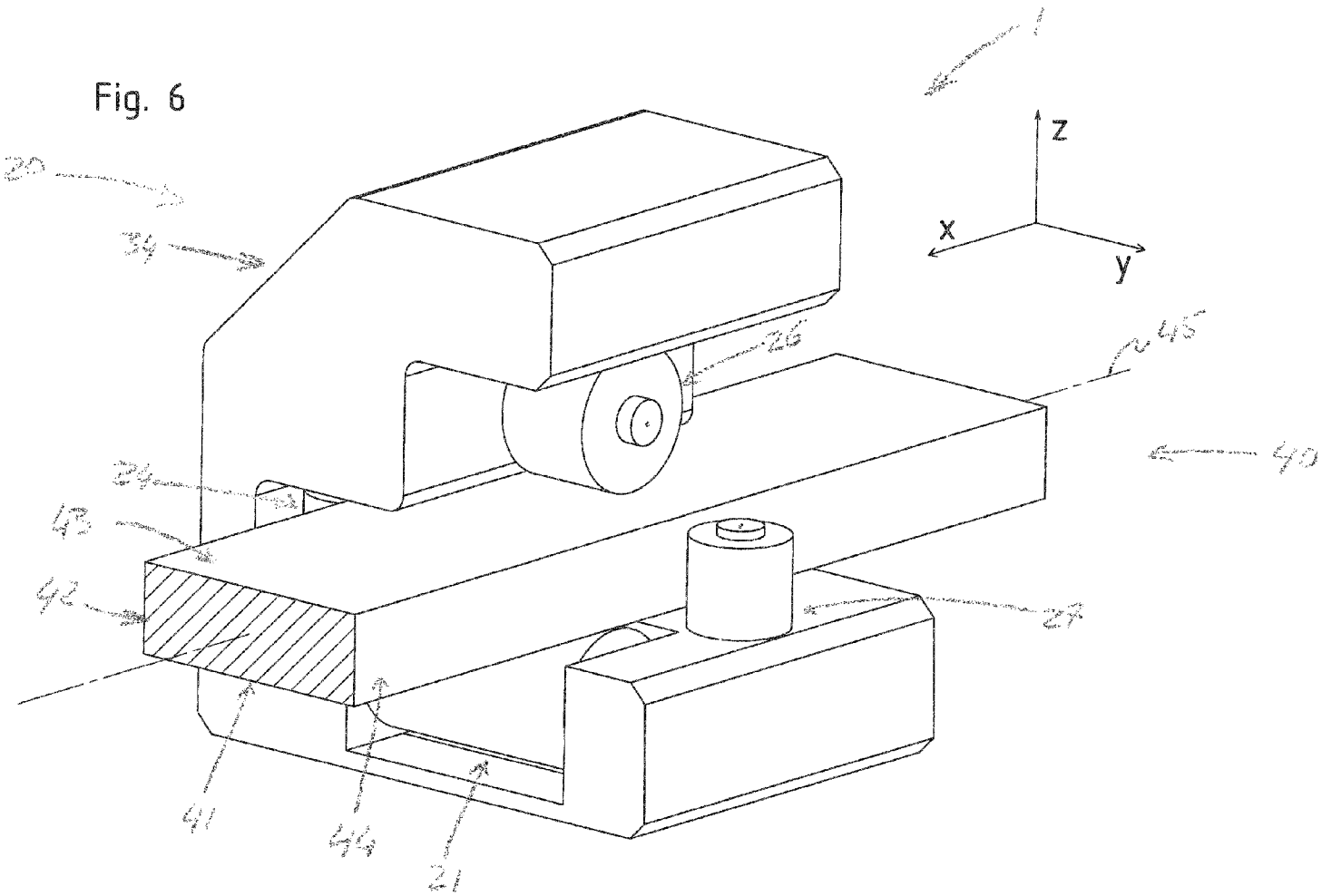

FIG. 6 shows an assembly 1 comprising the vehicle 20 of FIG. 4 and a rail 40. Two rollers 21, 22 are in contact with the first rail side.

As indicated in relation to FIGS. 4 and 5, in one embodiment the first roller 21 (see also FIG. 18) has one contact area 28 which, in a direction along the first rail side 41 and perpendicular to the longitudinal rail axis 45, extends over a distance from a first location 35 to a second location 36. The contact area 28 of the second roller 22 is, in a direction along the first rail side 41 and perpendicular to the longitudinal rail axis 45, located between the first location 35 and second location 36. In a view in a direction perpendicular to the first rail side 41, a two dimensional form 33 is defined by the first location 35 and second location 36 of the first roller 21 and the contact area 28 of the second roller 22.

In another embodiment (see also FIG. 19), the first roller 21 has two contact areas 28 which, in a direction along the first rail side 41 and perpendicular to the longitudinal rail axis 45, are located at a distance from each other. The contact area 28 of the second roller 22 is, in a direction along the first rail side 41 and perpendicular to the longitudinal rail axis 45, located between the two contact areas 28 of the first roller 21. In a view in a direction perpendicular to the first rail side 41, a two dimensional form 33 is defined by the three contact areas 28 of the first roller 21 and second roller 22.

Figure 7:
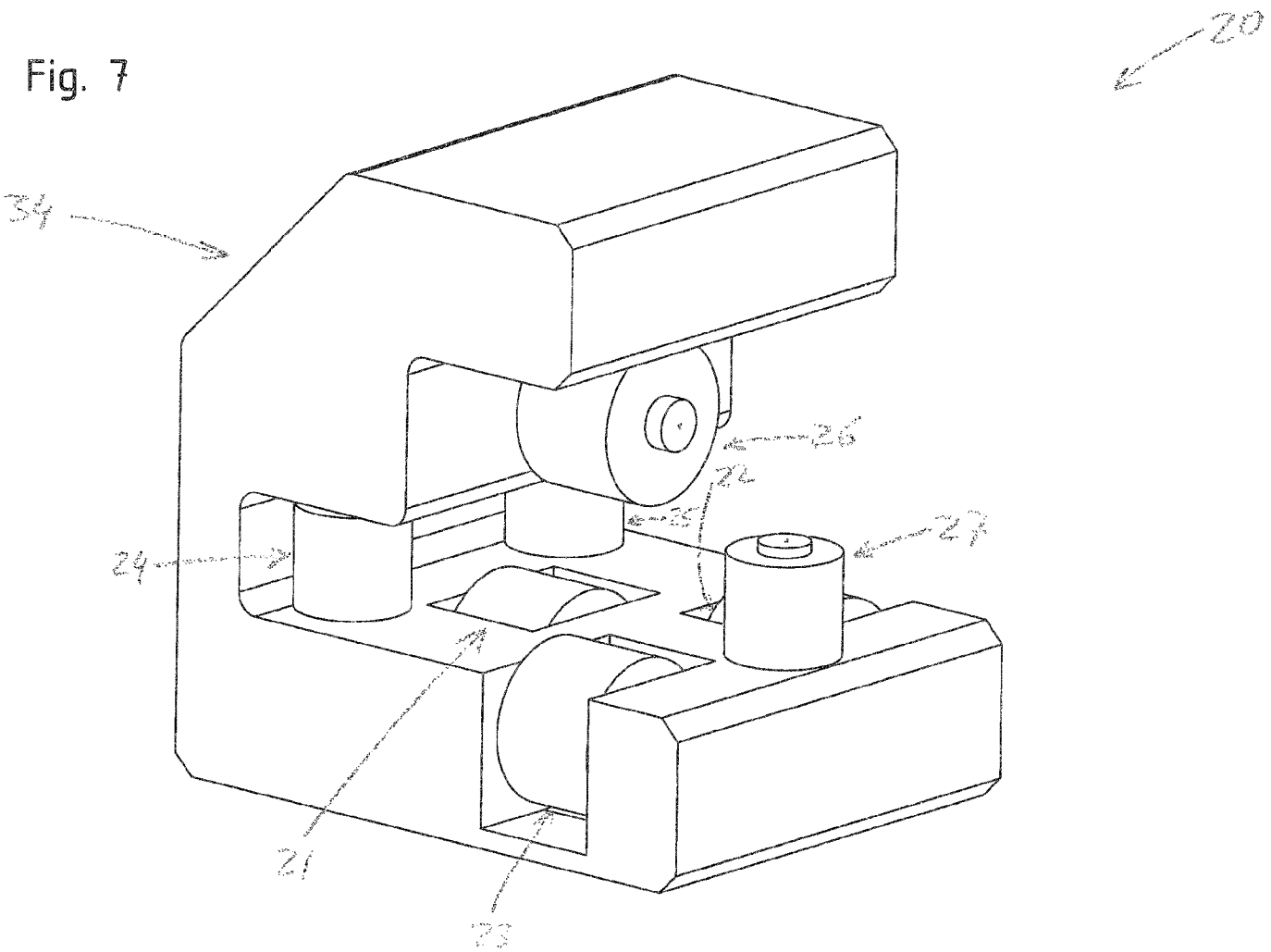
Figure 8:
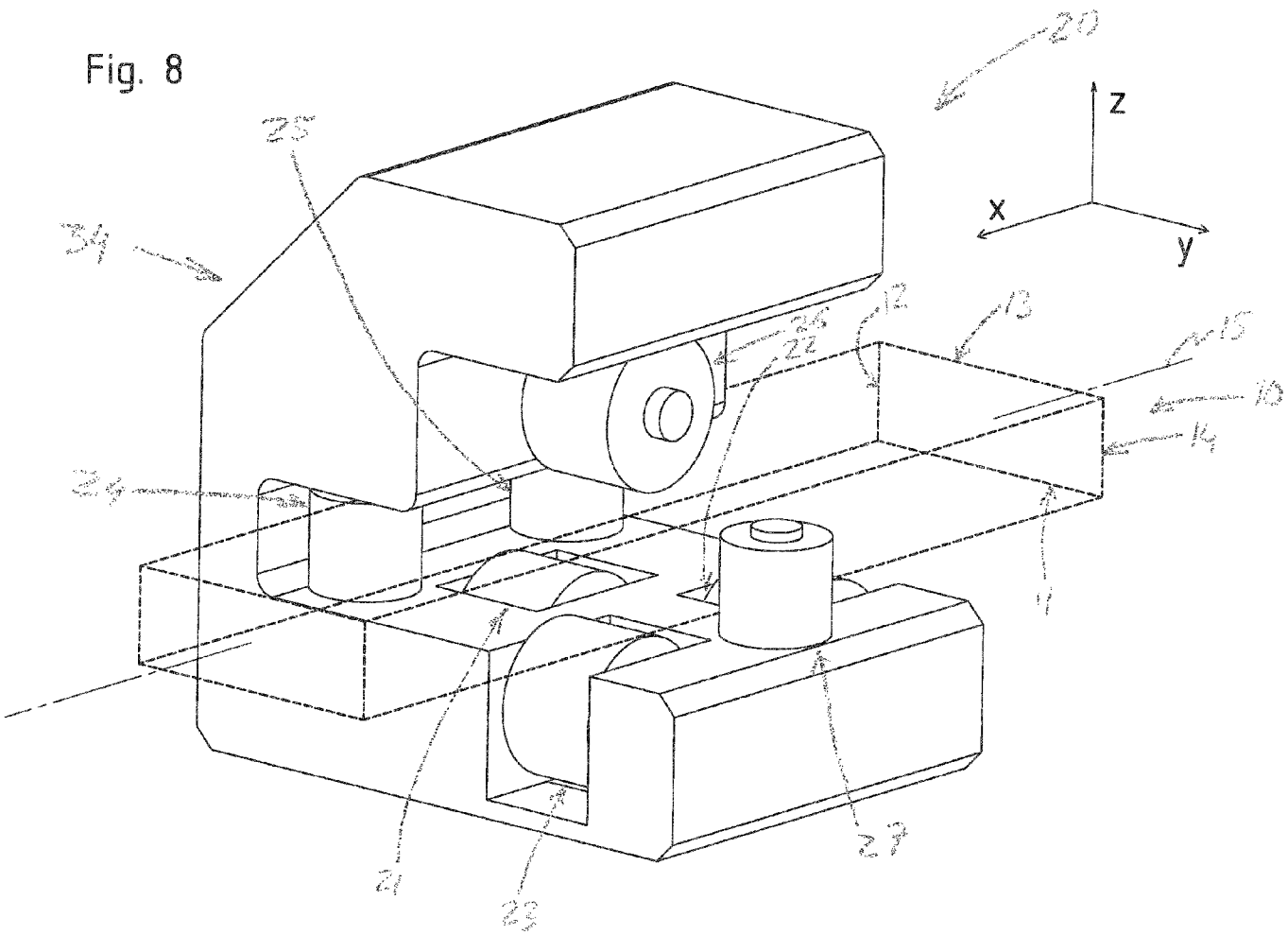
Figure 9:
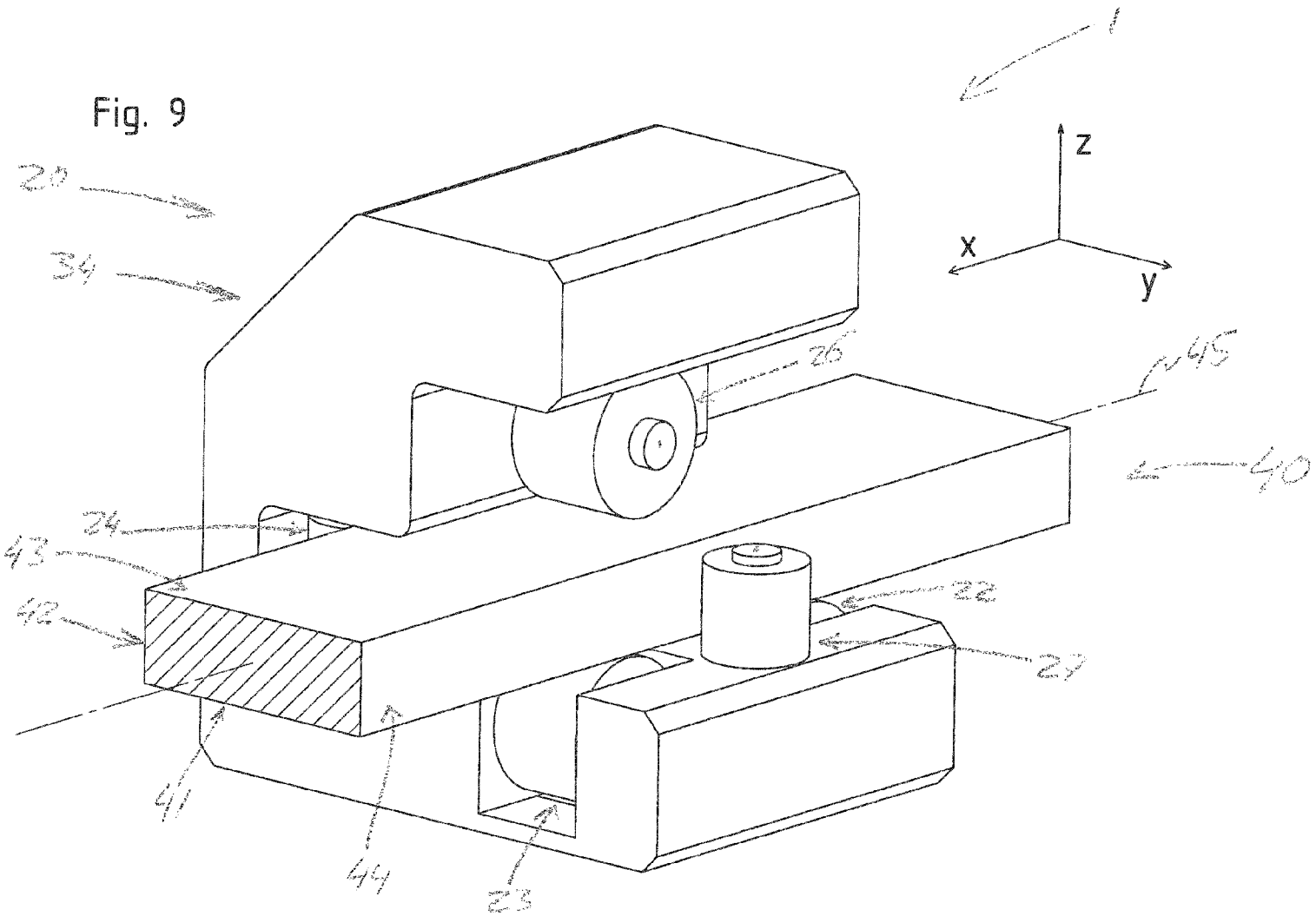

The FIGS. 7-9 show a further embodiment of the vehicle 20 and assembly 1 according to the invention.

In the vehicles shown in the FIGS. 1, 2, 4, 5, 7 and 8, all the rollers 21-27 are formed by a guiding wheel 31 and the wheel axes 32 of said guiding wheels 31 extend parallel to the first beam side 11, second beam side 12, third beam side 13 or fourth beam side 14 defined by the respective guiding wheel 31.

In the assemblies shown in the FIGS. 3, 6 and 9, all the rollers 21-27 are formed by a guiding wheel 31 and the wheel axes 32 of said guiding wheels 31 extend parallel to the first rail side 41, second rail side 42, third rail side 43 or fourth rail side 44 in contact with the respective guiding wheel 31.

Figure 13:
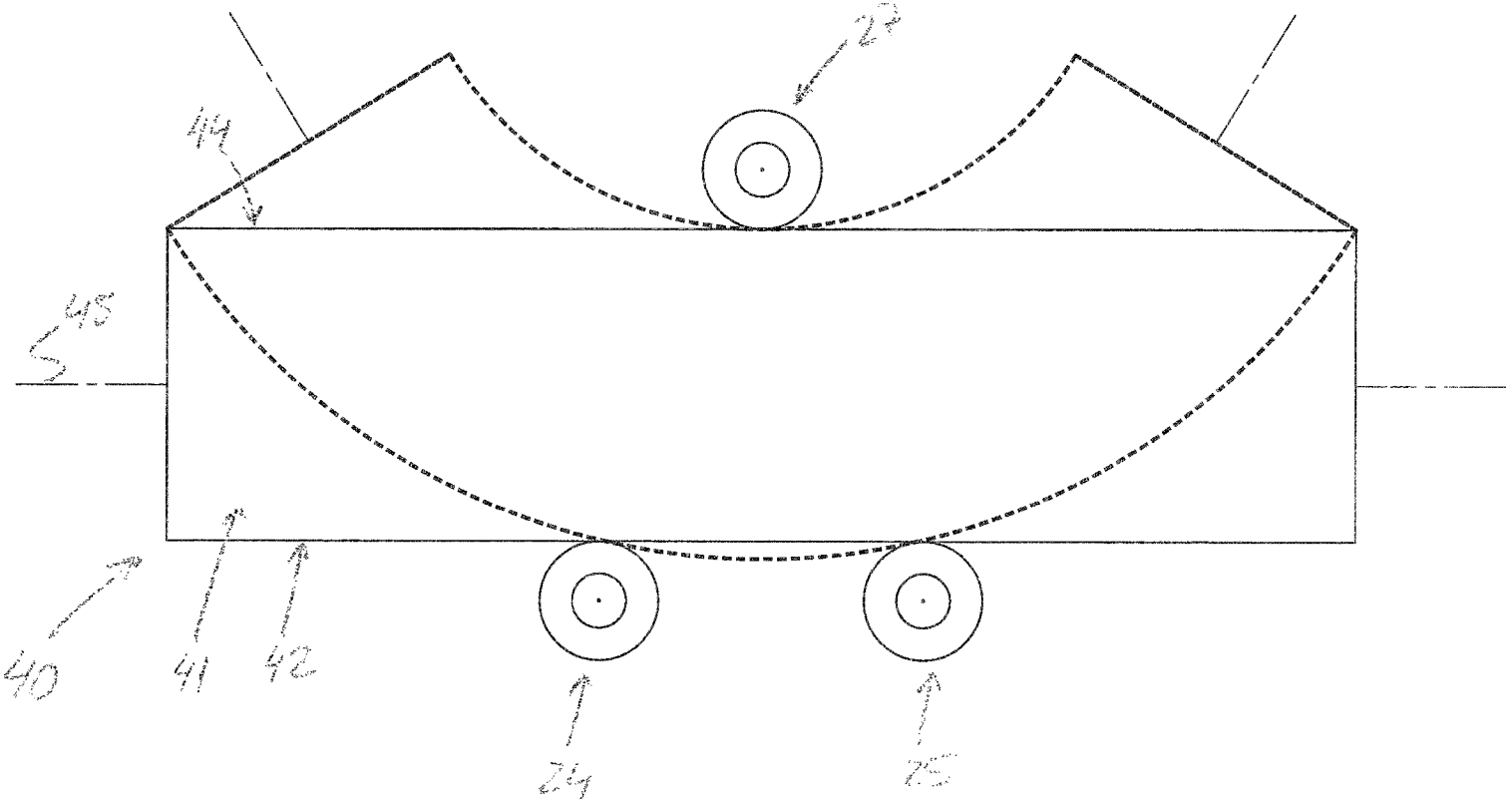
Figure 14:
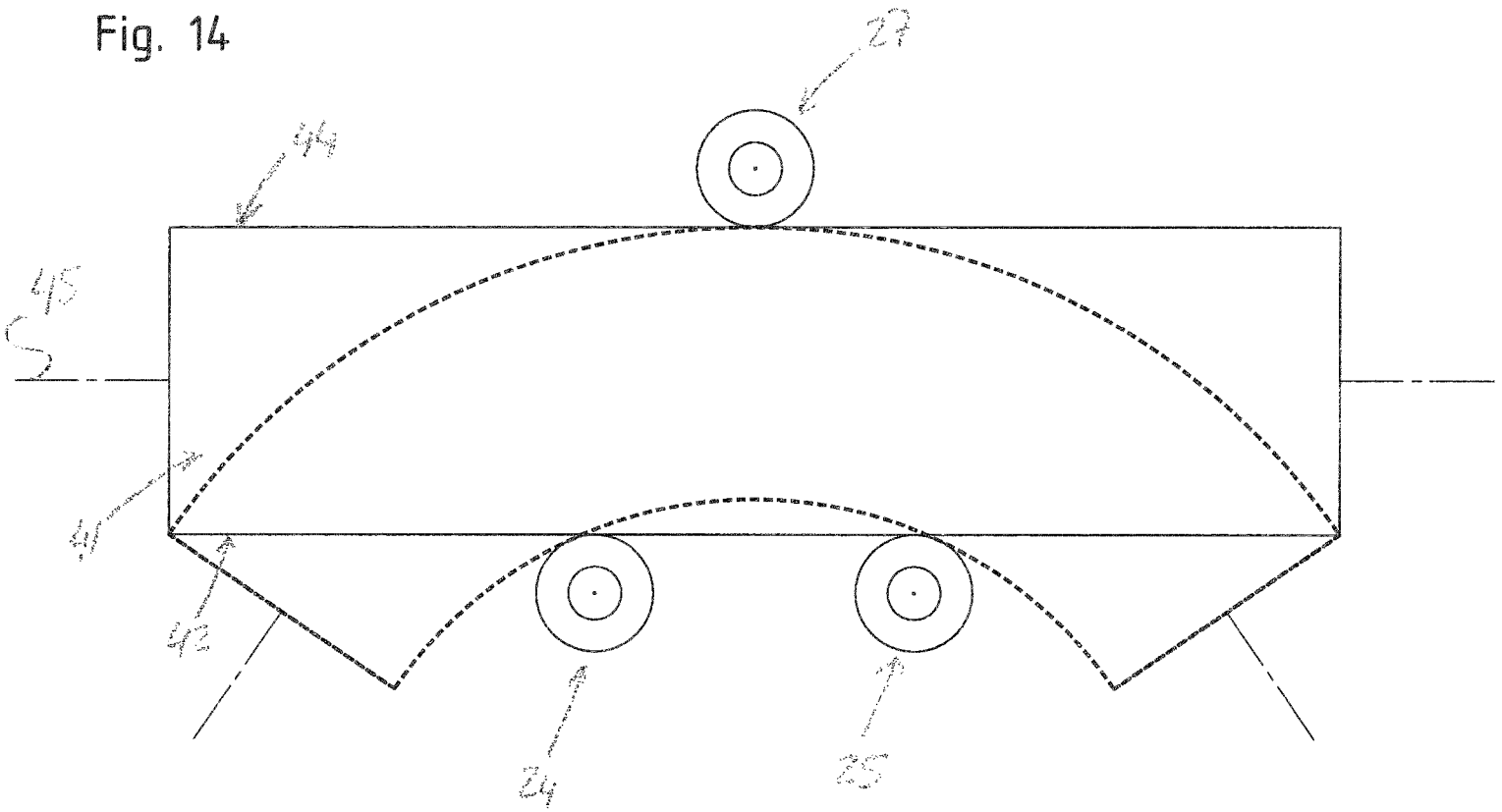

The FIGS. 13 and 14 show the fourth roller 24, fifth roller 25 and seventh roller 27 of the assemblies of FIGS. 3, 6 and 9 with a straight section of the rail 40 and a section of the rail 40 having a curve in the y-direction. It will be clear that the dimensions of the curved section of the rail 40 in the y-direction need some adjustment. The rail 40 remains its rectangular form 2 in cross section.

Figure 15:
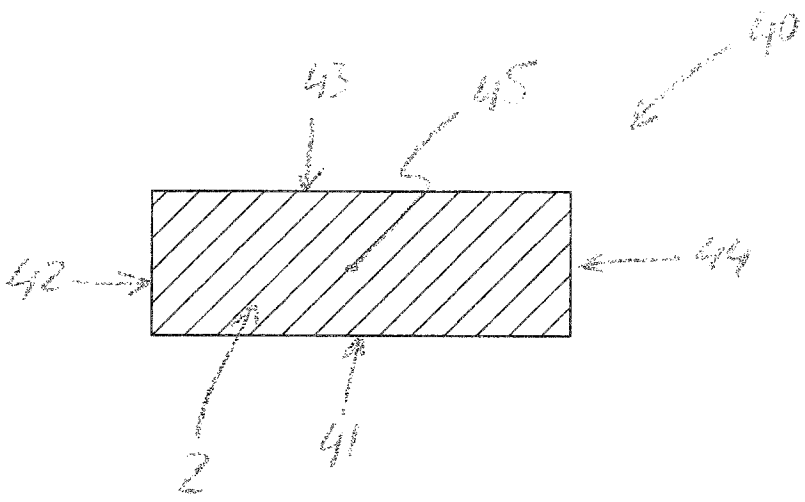

FIG. 15 shows a view of the rail 40 in cross section perpendicular to the longitudinal rail axis 45. In said cross section, the first rail side 41, second rail side 42, third rail side 43 and fourth rail side 44 define a rectangle 2. The rails 40 of the assemblies of the FIGS. 3 and 6 have a rectangular form 2 in cross section in sections having a curve in the y-direction or z-direction. The rail 40 of the assembly 1 of FIG. 9 has a rectangular form 2 in cross section in sections having a curve in the y-direction.

Figure 16:
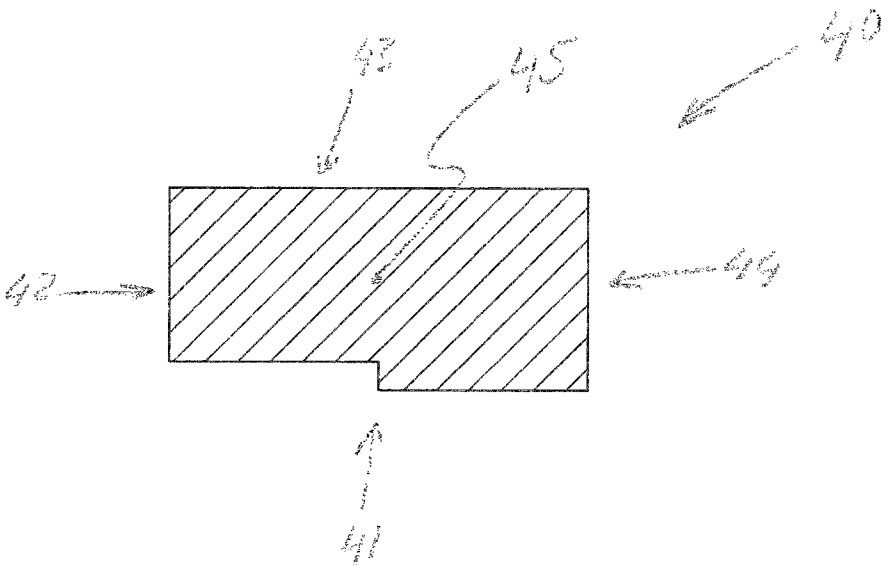

FIG. 16 shows a view of the rail 40 of the assembly 1 of FIG. 9 in cross section perpendicular to the longitudinal rail axis 45, wherein the rail 40 has a curve in the z-direction.

Figure 17:
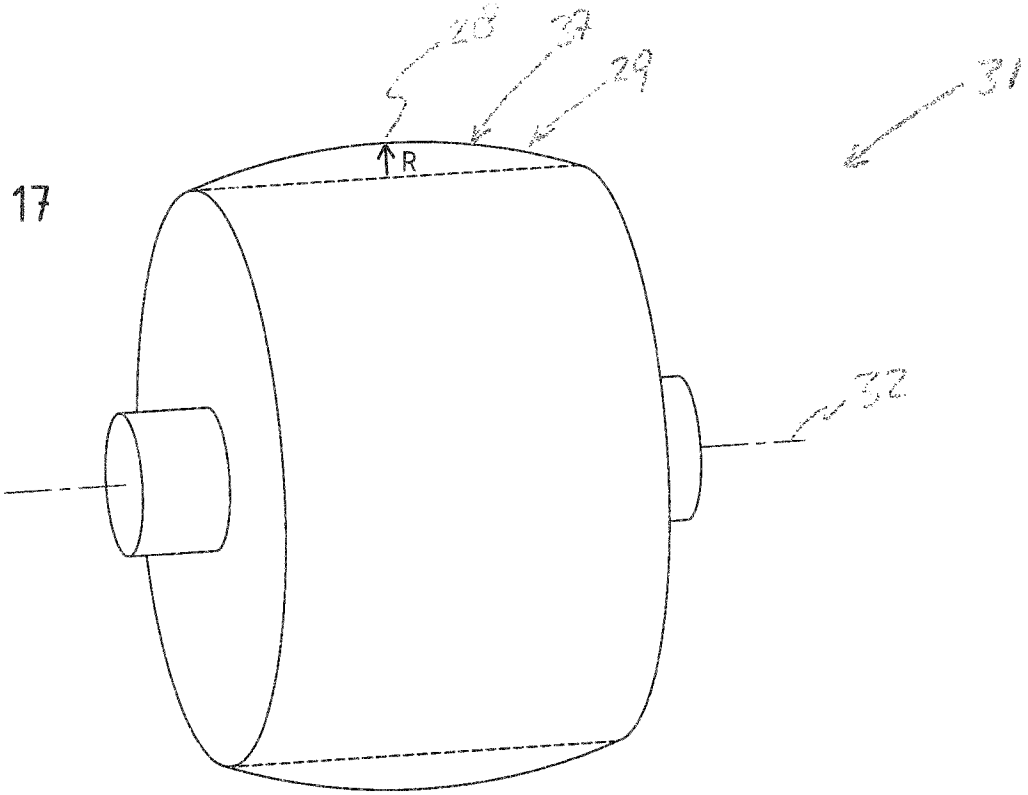

FIG. 17 shows a view of a guiding wheel 31 used for the first, second, third, fourth, fifth, sixth and seventh roller 21-27 of FIGS. 1 and 7 and the second, fourth, fifth, sixth and seventh roller 22, 24-27 of FIG. 4. Said guiding wheel 31 comprises a contact surface 29 forming the contact area 28. The contact surface 29 has, in the direction of the wheel axis 32, an outwardly extending curve 37. The curve 37 has, in the direction of the wheel axis 32, the form of a part of a circle. The radius (R) of the curve 37 is schematically indicated. As a result of the curve 37, the guiding wheel 31 has a small contact area 28 with which it is in contact with the respective first, second, third or fourth rail side 41-44 of the rail 40. Due to the fact that the contact surface 29 of the guiding wheel 31 is made of a very stiff material, such as a metallic material (for example steel, aluminium or titanium) or a ceramic material, the contact area 28 of the guiding wheel 31 can be considered to have to form of a "point contact".

FIG. 18 shows a view of a guiding wheel 31 which can be used for the first roller 21 of FIG. 4. The first roller 21 is formed by a guiding wheel 31 comprising a contact surface 29 which, in the direction of the wheel axis 32, extends along a straight line between the first location 35 and the second location 36. Due to the fact that the contact surface 29 of the guiding wheel 31 is made of a very stiff material, such as a metallic material (for example steel, aluminium or titanium) or a ceramic material, the contact area 28 of the guiding wheel 31 can be considered to have to form of a "line contact".

FIG. 19 shows a view of a guiding wheel 31 which can be used for the first roller 21 of FIGS. 3 and 4. The first roller 21 is formed by a guiding wheel 31 comprising a contact surface 29 which, in the direction of the wheel axis 32, has two outwardly extending curves 37 which are located at a distance from each other and form the two contact areas 28. Each curve 37 has, in the direction of the wheel axis 32, the form of a part of a circle. The radius (R) of the curve 37 is schematically indicated. As a result of the curves 37, the guiding wheel 31 has two small contact area 28 with which are in contact with the first rail side 41 of the rail 40. Due to the fact that the contact surface 29 of the guiding wheel 31 is made of a very stiff material, such as a metallic material (for example steel, aluminium or titanium) or a ceramic material, the contact areas 28 of the guiding wheel 31 can be considered to have to form of a "point contact".

In the embodiments shown, all the rollers 21-27 are formed by a guiding wheel 31 rotatable around a wheel axis 32. Other types of rollers 21-27 may be used. In another example, one of the rollers 21-27, a part of the rollers 21-27, or all the rollers 21-27 are formed by a rollable guiding ball.

FIGS. 20, 21, 23, 24 and 25 show a further embodiment of the vehicle 20 according to the invention. Two rollers 21, 22 define the first beam side 11. The vehicle 20 comprises two further rollers (a first further roller 61 and a second further roller 62) comprising a further contact area 63 which in use is in contact with a further rail 50. The further contact areas 63 are located at a distance from the beam 10. This is advantageous to prevent that the vehicle 20 rotates about the longitudinal beam axis 15. In other examples, the vehicle 20 comprises one further roller.

The two further rollers 61, 62 in use prevents rotation of the vehicle 20 about the longitudinal beam axis 15 by their contact with the further rail 50.

Each of the two further roller 61, 62 is positioned to in use be in contact with a surface 51, 52 of the further rail 50.

For each of the two further rollers 61, 62, the surface 51, 52 of the further rail 50 with which it in use is in contact extends parallel to the longitudinal beam axis 15.

For each of the two further rollers 61, 62, the surface 51, 52 of the further rail 50 with which it is in contact extends parallel to the first beam side 11 and third beam side 13.

The first further roller 61 is in use in contact with a first surface 51 of the further rail 50, and the second further roller 62 is in use in contact with a second surface 52 of the further rail 50.

The first further roller 61 and second further roller 62 rotate in use in opposite direction.

The first further roller 61 and second further roller 62 are formed by guiding wheels 31 and the wheel axes 32 of said guiding wheels 31 extend parallel to each other. In other examples, at least one of the two further rollers 61, 62 is formed by a rollable guiding ball and/or at least one of the two further rollers 61, 62 is formed by a guiding wheel 31 rotatable around a wheel axis 32.

The wheel axes 32 of the first further roller 61 and second further roller 62 extend perpendicular to the second beam side 12 and fourth beam side 14.

The distance between the further contact area 63 of each of the two further rollers 61, 62 and the longitudinal beam axis 15 is between 3, 5 and 15 times, preferably between 5 and 10 times, the distance between the first beam side 11 and third beam side 13.

The distance between the further contact area 63 of each of the two further roller 61, 62 and the longitudinal beam axis 15 is between 3, 5 and 15 times, preferably between 5 and 10 times, the distance between the second beam side 12 and fourth beam side 14.

In use, the further rail 50 extends parallel to the beam 10.

Figure 20:
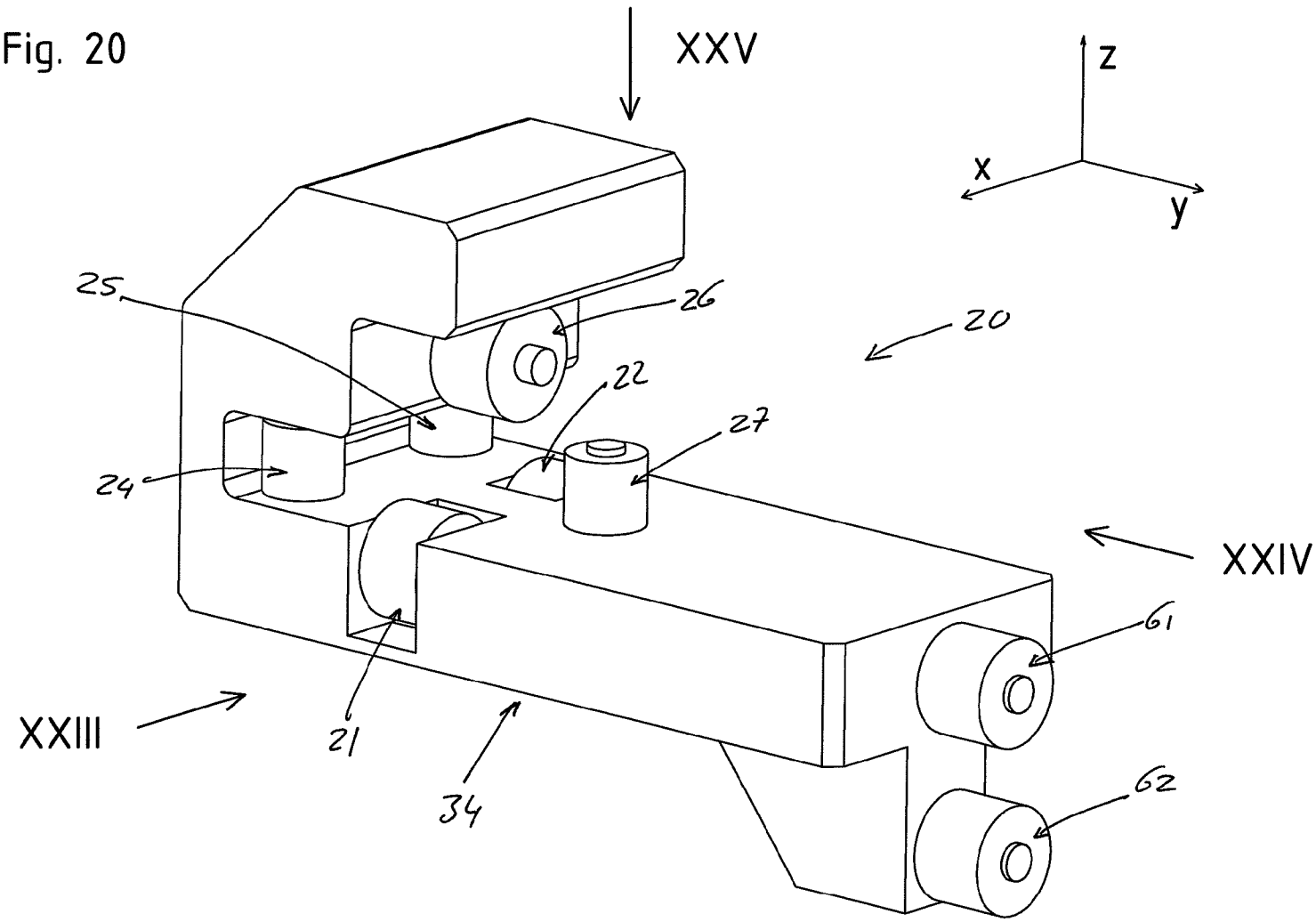
Figure 21:
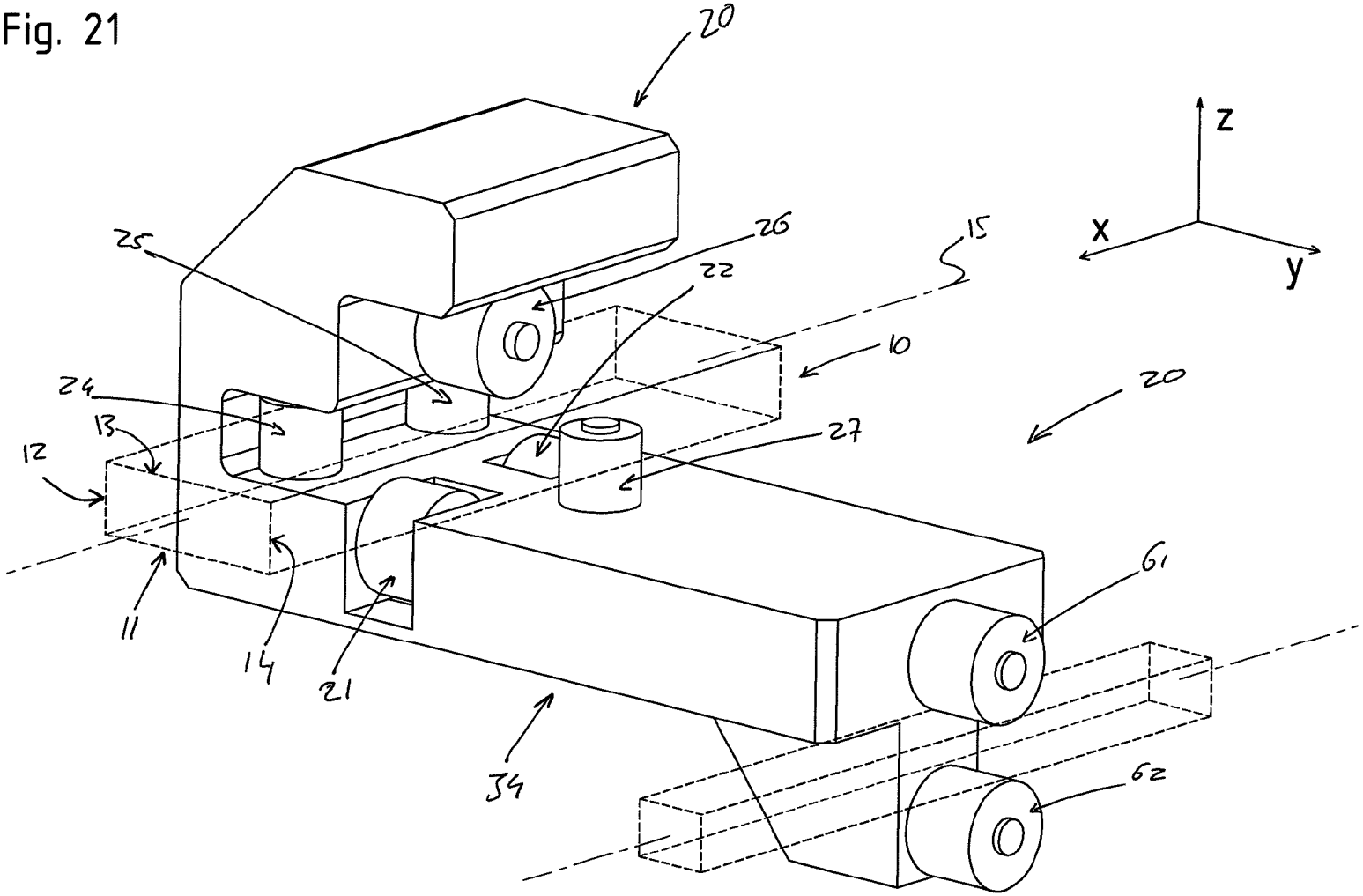
Figure 22:
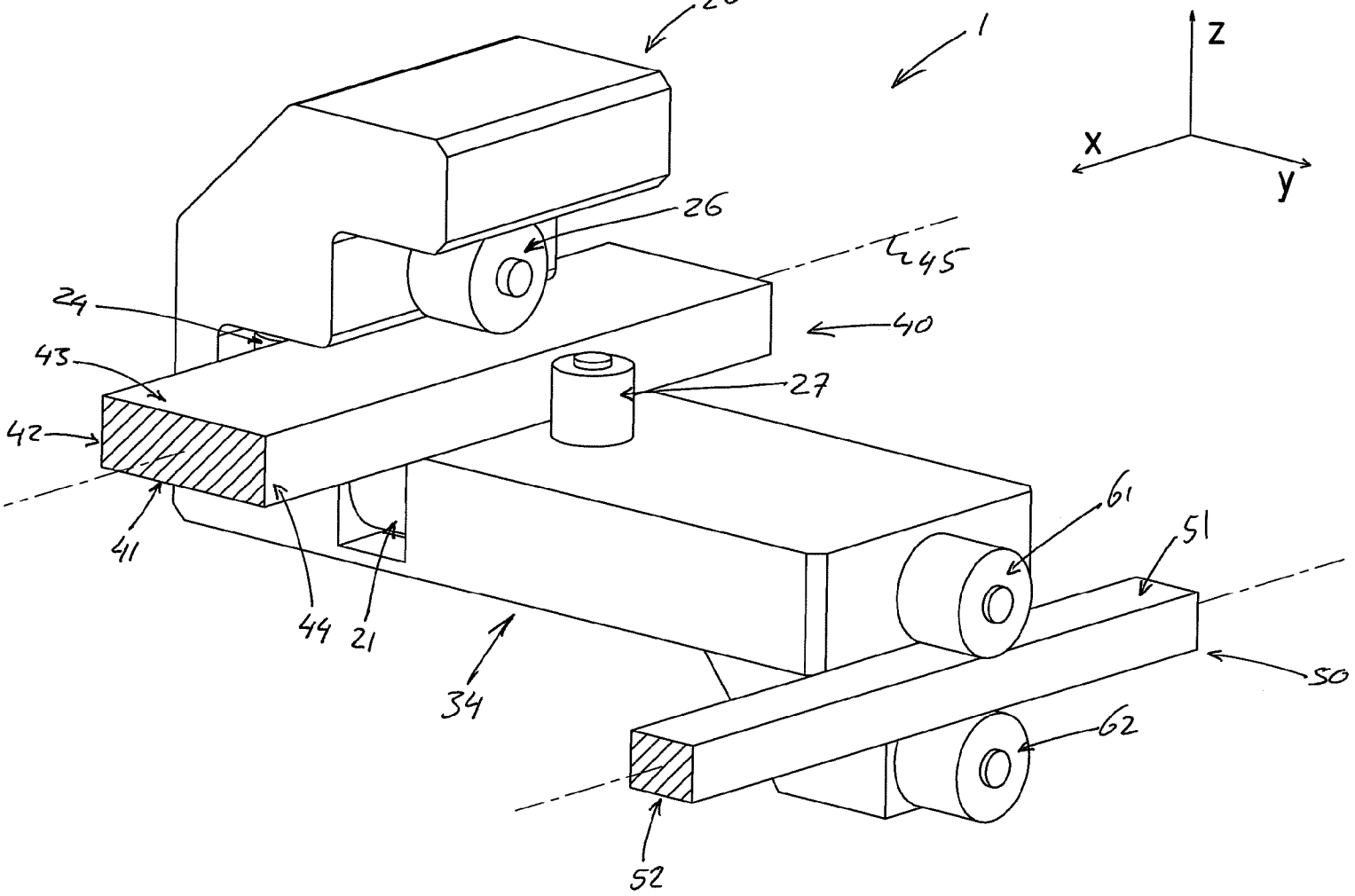
Figure 23:
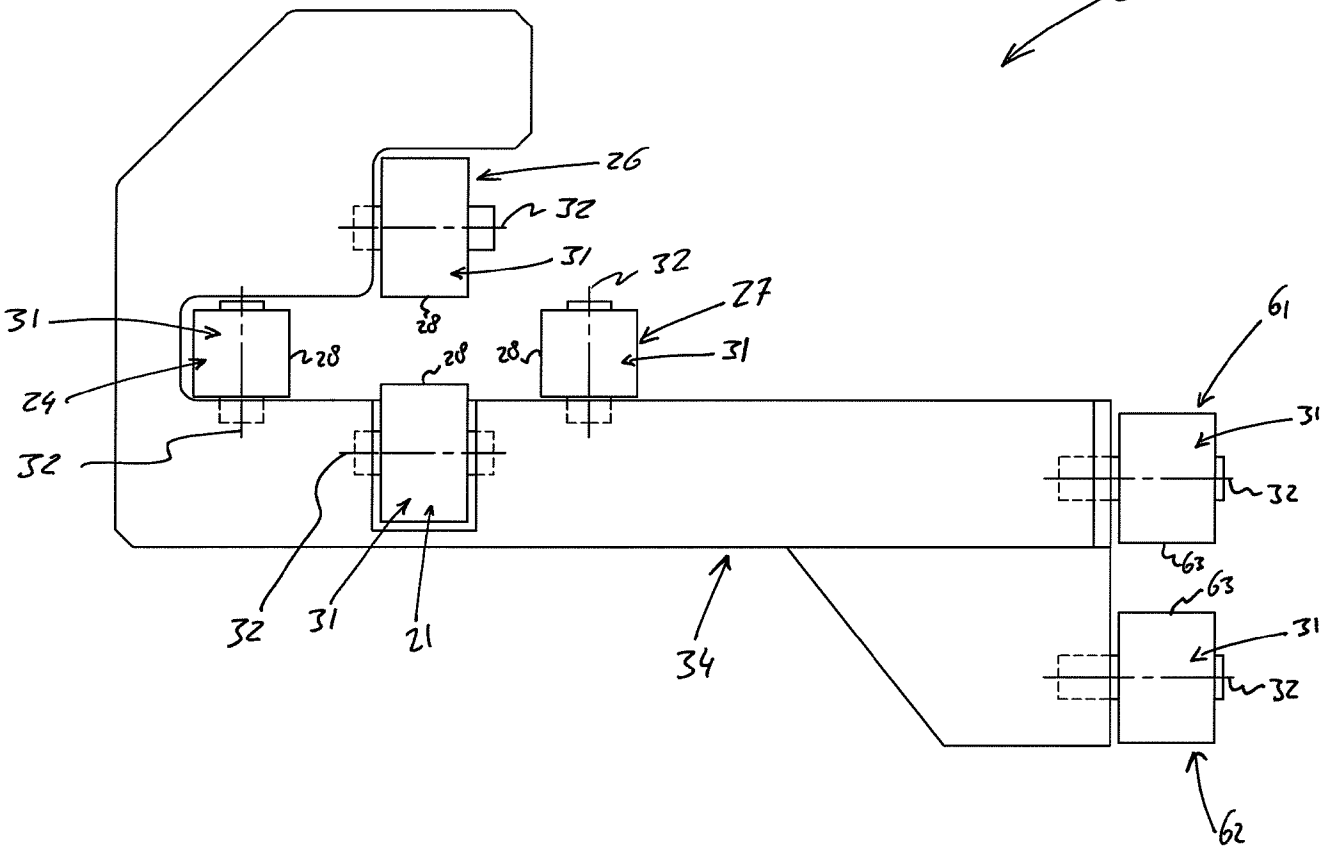
Figure 24:
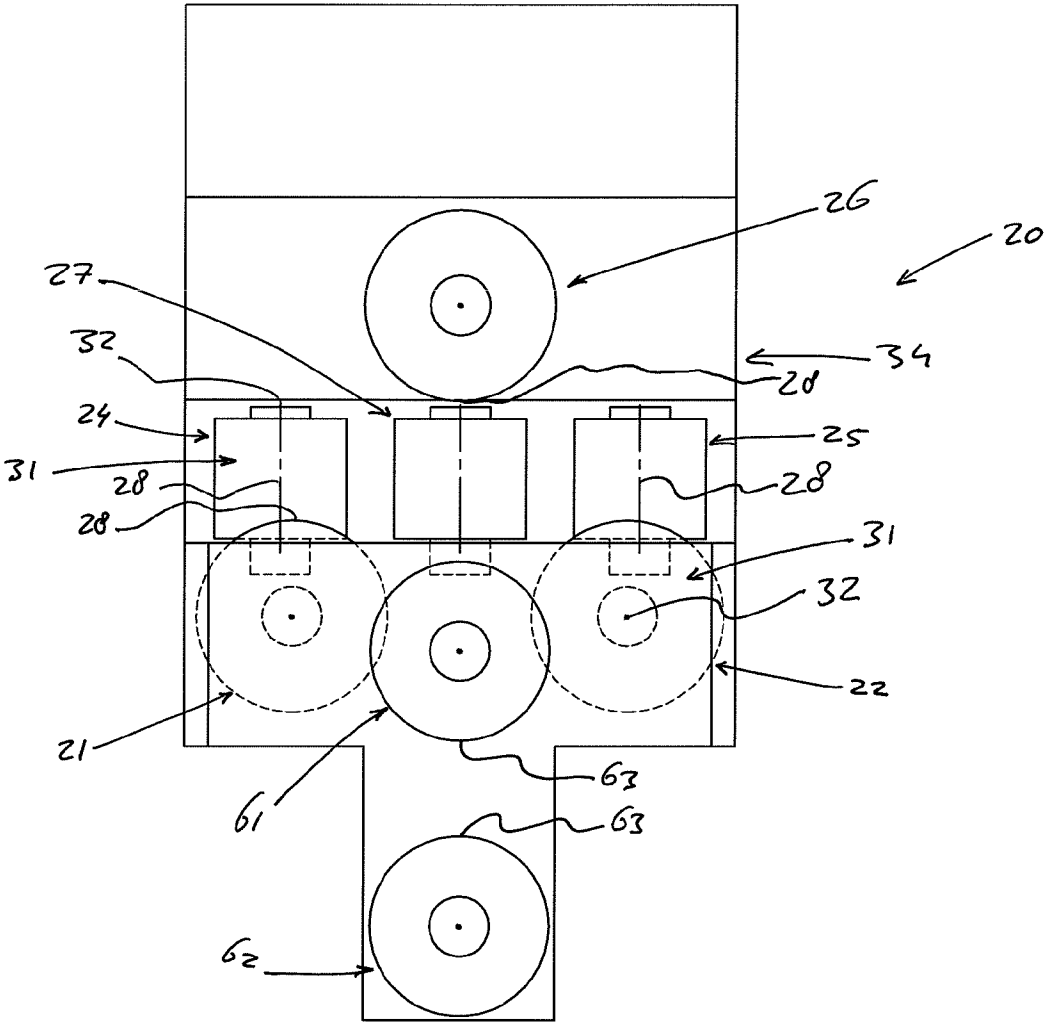
Figure 25:
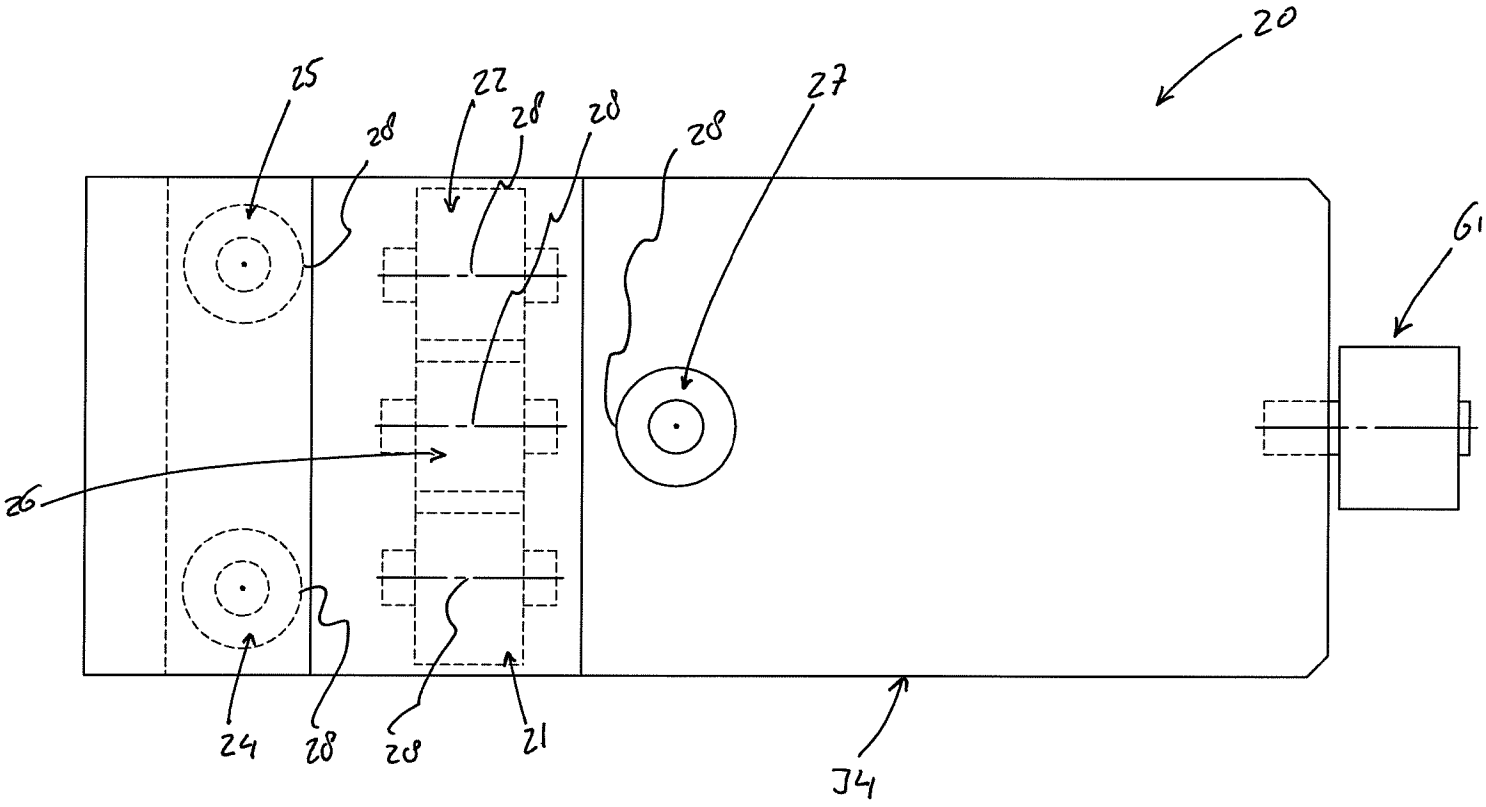

FIG. 22 schematically shows a view in perspective of a further embodiment of the assembly 1 according to the invention and comprising the vehicle 20 of FIG. 20. Two rollers 21, 22 are in contact with the first rail side 41. The vehicle 20 comprises two further rollers (first further roller 61 and second further roller 62) comprising a further contact area 63 which is in contact with a further rail 50. The further contact areas 63 are located at a distance from the further rail 50. This is advantageous to prevent that the vehicle 20 rotates about the longitudinal rail axis 45. In other examples, the vehicle 20 comprises one further roller.

The two further roller 61, 62 prevent rotation of the vehicle 20 about the longitudinal rail 45 axis by its contact with the further rail 50.

Each of the two further rollers 61, 62 is in contact with a surface 51, 52 of the further rail 50.

For each of the two further roller 61, 62, the surface 51, 52 of the further rail 50 with which it is in contact extends parallel to the longitudinal rail axis 45.

For each of the two further roller 61, 62, the surface 51, 52 of the further rail 50 with which it is in contact extends parallel to the first rail side 41 and third rail side 43.

The first further roller 61 is in contact with a first surface 51 of the further rail 50, and the second further roller 62 is in contact with a second surface 52 of the further rail 50.

In use the first further roller 61 and second further roller 62 rotate in opposite direction.

The first further roller 61 and second further roller 62 are formed by guiding wheels 31 and the wheel axes 32 of said guiding wheels 31 extend parallel to each other. In other examples, at least one of the two further rollers 61, 62 is formed by a rollable guiding ball and/or least one of two further rollers 61, 62 is formed by a guiding wheel 31 rotatable around a wheel axis 31.

The wheel axes 32 of the first further roller 61 and second further roller 62 extend perpendicular to the second rail side 42 and fourth rail side 44.

The distance between the further contact area 63 of each of the two further rollers 61, 62 and the longitudinal rail axis 45 is between 3, 5 and 15 times, preferably between 5 and 10 times, the distance between the first rail side 41 and third rail side 43.

The distance between the further contact area 63 of each of two further rollers 61, 62 and the longitudinal rail axis 15 is between 3, 5 and 15 times, preferably between 5 and 10 times, the distance between the second beam side 42 and fourth beam side 44.

The further rail 50 extends parallel to the rail 40.

Figure 26:
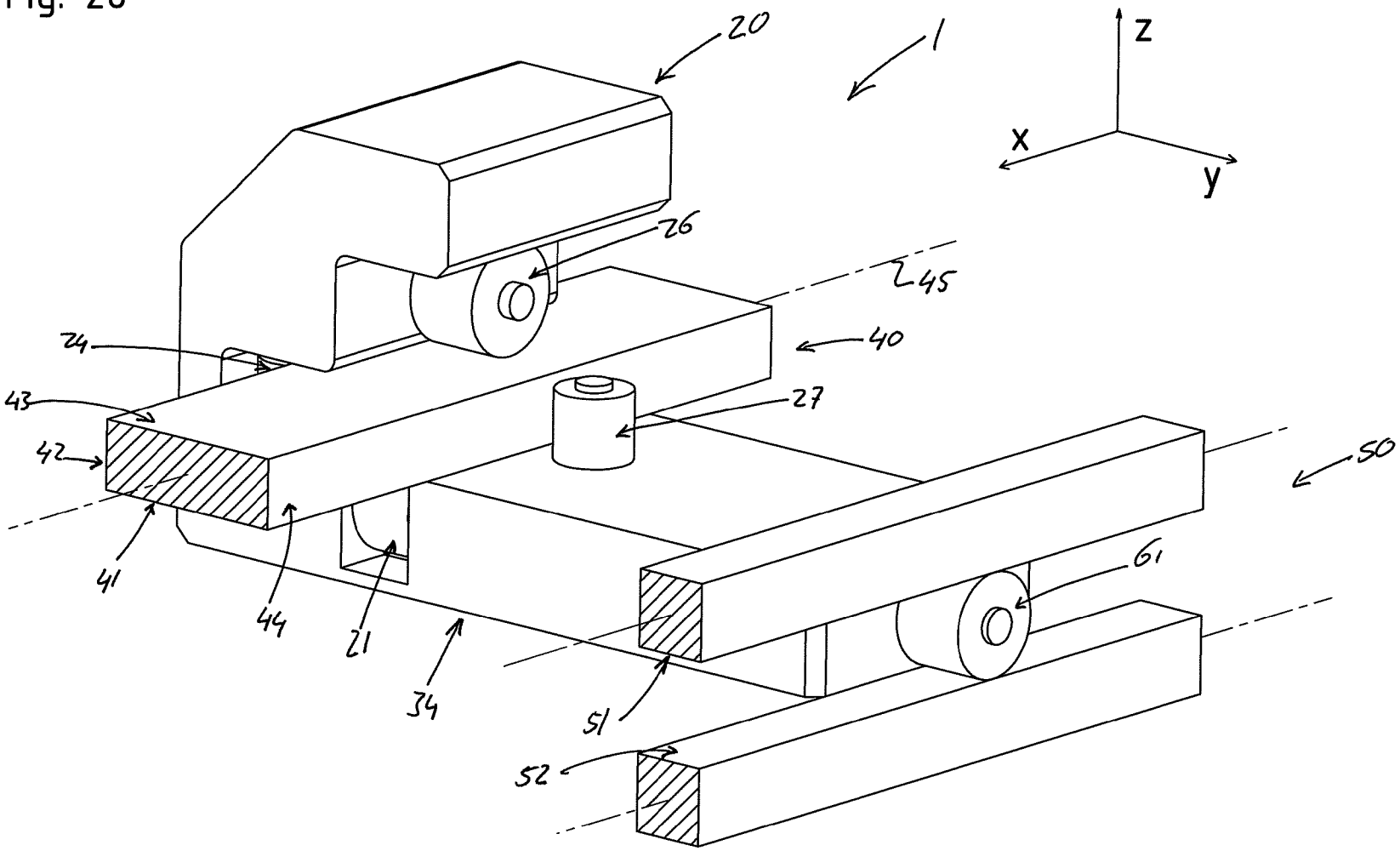

FIG. 26 shows a view in perspective of a further embodiment of the assembly according to the invention. The vehicle 20 has one further roller (first further roller 61). The first further roller 61 is in contact with a first surface 51 of the further rail 50 or a second surface 52 of the further rail 50. The first surface 51 and the second surface 52 of the further rail 50 extend parallel to each other. The first further roller 61 is formed by a guiding wheel 31 and the wheel axis of said guiding wheel extends perpendicular to the second rail side 42 and fourth rail side 44.

It will be apparent to those skilled in the art that various modifications can be made to the assembly 1 without departing from the scope as defined in the claims.

While various embodiments of the present invention are specifically illustrated and/or described herein, it will be appreciated that modifications and variations of the present invention may be effected by those skilled in the art without departing from the spirit and intended scope of the invention. Further, any of the embodiments of the invention as described in the claims or in the specification or clauses described in the specification may be used with one and another without limitation.

Clause 1. Vehicle configured to be moved along a rail and comprising rollers which in use engage the rail such that each roller has a contact area with which said roller is in contact with the rail, wherein the contact areas of the rollers are positioned to define a beam with a longitudinal beam axis, a rectangular form in a cross section perpendicular to the longitudinal beam axis and a first beam side, a second beam side, a third beam side and a fourth beam side, in which the first and third beam side extend perpendicular to the second and fourth beam side, at least two rollers define the first beam side, two rollers define the second beam side, one roller defines the third beam side, and one roller defines the fourth beam side.

Clause 2. Vehicle according to clause 1, wherein the vehicle comprises a maximum of three rollers defining the first beam side.

Clause 3. Vehicle according to clause 1, wherein the vehicle comprises exactly two rollers defining the first beam side.

Clause 4. Vehicle according to clause 1 or 3, wherein two rollers define the first beam side, said rollers are formed by a first roller and a second roller, and the first roller has one contact area which, in a direction along the first beam side and perpendicular to the longitudinal beam axis, extends over a distance from a first location to a second location.

Clause 5. Vehicle according to clause 4, wherein the second roller is, in a direction along the first beam side and perpendicular to the longitudinal beam axis, located between the first location and second location.

Clause 6. Vehicle according to clause 5, wherein in a view in a direction perpendicular to the first beam side, a two dimensional form is defined by the first location and second location of the first roller and the contact area of the second roller.

Clause 7. Vehicle according to clause 1 or 3, wherein two rollers define the first beam side, said rollers are formed by a first roller and a second roller, and the first roller has two contact areas which, in a direction along the first beam side and perpendicular to the longitudinal beam axis, are located at a distance from each other.

Clause 8. Vehicle according to clause 7, wherein the second roller is, in a direction along the first beam side and perpendicular to the longitudinal beam axis, located between the two contact areas of the first roller.

Clause 9. Vehicle according to clause 8, wherein in a view in a direction perpendicular to the first beam side, a two dimensional form is defined by the three contact areas of the first roller and second roller.

Clause 10. Vehicle according to clause 1 or 2, wherein the vehicle comprises exactly three rollers defining the first beam side.

Clause 11. Vehicle according to clause 1, 2 or 10, wherein three rollers define the first beam side and, in a view in a direction perpendicular to the first beam side, a two dimensional form is defined by the contact areas of said three rollers.

Clause 12. Vehicle according to clause 11, wherein the three rollers are formed by a first roller, a second roller and a third roller, a straight line extending through the contact areas of the first roller and the third roller extends perpendicular to the longitudinal beam axis.

Clause 13. Vehicle according to any of the clauses 6, 9, 11, 12, wherein the two-dimensional form is symmetric.

Clause 14. Vehicle according to clause 13, wherein the symmetric two-dimensional form has an axis of symmetry, and the longitudinal beam axis, in a view in a direction perpendicular to the first beam side, overlaps the axis of symmetry.

Clause 15. Vehicle according to any of the preceding clauses, wherein the vehicle comprises exactly two rollers defining the second beam side.

Clause 16. Vehicle according to any of the preceding clauses, wherein the two rollers defining the second beam side are located at a distance from each other in the direction of the longitudinal beam axis.

Clause 17. Vehicle according to any of the preceding clauses, wherein the vehicle comprises exactly one roller defining the third beam side.

Clause 18. Vehicle according to any of the preceding clauses, wherein the roller defining the third beam side is, in a view in a direction perpendicular to the third beam side, located in the two dimensional form of the rollers defining the first beam side.

Clause 19. Vehicle according to any of the preceding clauses, wherein the vehicle comprises exactly one roller defining the fourth beam side.

Clause 20. Vehicle according to any of the preceding clauses, wherein the contact area of the roller defining the fourth beam side is, in the direction of the longitudinal beam axis, located between the contact areas of the two rollers defining the second beam side.

Clause 21. Vehicle according to any of the preceding clauses, wherein at least one of the rollers is formed by a rollable guiding ball.

Clause 22. Vehicle according to any of the preceding clauses, wherein at least one of the rollers is formed by a guiding wheel rotatable around a wheel axis.

Clause 23. Vehicle according to clause 22, wherein at least six of the rollers defining the first beam side, the second beam side, the third beam side, the fourth beam side, the fifth beam side, and the sixth beam side are formed by guiding wheels, and the wheel axes of said guiding wheels do not coincide.

Clause 24. Vehicle according to clause 22, wherein all the rollers defining the first beam side, the second beam side, the third beam side, the fourth beam side, the fifth beam side, and the sixth beam side are formed by guiding wheels, and the wheel axes of said guiding wheels do not coincide.

Clause 25. Vehicle according to any of the preceding clauses, wherein the rollers defining the first beam side are formed by guiding wheels and the wheel axes of said guiding wheels extend perpendicular to the second beam side and fourth beam side.

Clause 26. Vehicle according to any of the clauses 1-3, 10-25, and in combination with any of the clauses 4-6, wherein the first roller is formed by a guiding wheel extending between the first location and second location.

Clause 27. Vehicle according to any of the clauses 1-3, 10-25, and in combination with any of the clauses 7-9, wherein the first roller is formed by a guiding wheel extending between the two contact areas of the first roller.

Clause 28. Vehicle according to any of the preceding clauses, wherein the two rollers defining the second beam side are formed by guiding wheels and the wheel axes of said guiding wheels extend perpendicular to the first beam side and third beam side.

Clause 29. Vehicle according to any of the preceding clauses, wherein the roller defining the third beam side is formed by a guiding wheel and the wheel axis of said guiding wheel extends perpendicular to the second beam side and fourth beam side.

Clause 30. Vehicle according to any of the preceding clauses, wherein the roller defining the fourth beam side is formed by a guiding wheel and the wheel axis of said guiding wheel extends perpendicular to the first beam side and third beam side.

Clause 31. Vehicle according to any of the clauses 1-20, 22-30, wherein all the rollers are formed by a guiding wheel and the wheel axes of said guiding wheels extend parallel to the first beam side, second beam side, third beam side or fourth beam side defined by the respective guiding wheel.

Clause 32. Vehicle according to any of the clauses 22-31, wherein the guiding wheel comprises a contact surface forming the contact area and the contact surface has, in the direction of the wheel axis, an outwardly extending curve.

Clause 33. Vehicle according to any of the clauses 1-3, 10-25, 28-32, and in combination with any of the clauses 4-6, 26, wherein the first roller is formed by a guiding wheel comprising a contact surface which, in the direction of the wheel axis, extends along a straight line between the first location and the second location.

Clause 34. Vehicle according to any of the clauses 1-3, 10-25, 28-32, and in combination with any of the clauses 7-9, 27, wherein the first roller is formed by a guiding wheel comprising a contact surface which, in the direction of the wheel axis, has two outwardly extending curves which are located at a distance from each other and form the two contact areas.

Clause 35. Vehicle according to any of the preceding clauses, wherein the rollers comprise a contact surface of a metallic material, such as steel, aluminium or titanium, or a ceramic material.

Clause 36. Vehicle according to any of the preceding clauses, wherein two rollers define the first beam side, the vehicle comprises at least one further roller comprising a further contact area which in use is in contact with a further rail, and the further contact area is located at a distance from the beam.

Clause 37. Vehicle according to clause 36, wherein the at least one further roller in use prevents rotation of the vehicle about the longitudinal beam axis by its contact with the further rail.

Clause 38. Vehicle according to clause 36 or 37, wherein each of the at least one further roller is positioned to in use be in contact with a surface of the further rail.

Clause 39. Vehicle according to clause 38, wherein for each of the at least one further roller, the surface of the further rail with which it in use is in contact extends parallel to the longitudinal beam axis.

Clause 40. Vehicle according to clause 38 or 39, wherein for each of the at least one further roller, the surface of the further rail with which it is in contact extends parallel to the first beam side and third beam side.

Clause 41. Vehicle according to any of the clauses 36-40, wherein at least one of the at least one further roller is formed by a rollable guiding ball.

Clause 42. Vehicle according to any of the clauses 36-41, wherein at least one of the at least one further roller is formed by a guiding wheel rotatable around a wheel axis.

Clause 43. Vehicle according to clause 42, wherein for each guiding wheel, the wheel axis extends perpendicular to the first beam side and the third beam side, or to the second beam side and the fourth beam side.

Clause 44. Vehicle according to clause 36-43, wherein the at least one further roller has a first further roller and a second further roller, the first further roller is in use in contact with a first surface of the further rail, and the second further roller is in use in contact with a second surface of the further rail.

Clause 45. Vehicle according to clause 44, wherein in use the first further roller and second further roller rotate in opposite direction.

Clause 46. Vehicle according to clause 44 or 45, wherein the first further roller and second further roller are formed by guiding wheels and the wheel axes of said guiding wheels extend parallel to each other.

Clause 47. Vehicle according to clause 46, wherein the wheel axes of the first further roller and second further roller extend perpendicular to the second beam side and fourth beam side.

Clause 48. Vehicle according to clause 46, wherein the wheel axes of the first further roller and second further roller extend perpendicular to the first beam side and third beam side.

Clause 49. Vehicle according to any of the clauses 36-43, wherein the at least one further roller has a first further roller, the first further roller is in use in contact with a first surface of the further rail or a second surface of the further rail.

Clause 50. Vehicle according to clause 49, wherein the first further roller is formed by a guiding wheel and the wheel axis of said guiding wheel extends perpendicular to the second beam side and fourth beam side.

Clause 51. Vehicle according to clause 49, wherein the first further roller is formed by a guiding wheel and the wheel axes of said guiding wheel extends perpendicular to the first beam side and third beam side.

Clause 52. Vehicle according to any of the clauses 49-51, wherein the first surface and the second surface of the further rail extend parallel to each other.

Clause 53. Vehicle according to any of the clauses 36-52, wherein the distance between the further contact area of each of the at least one further roller and the longitudinal beam axis is between 3, 5 and 15 times, preferably between 5 and 10 times, the distance between the first beam side and third beam side.

Clause 54. Vehicle according to any of the clauses 36-53, wherein the distance between the further contact area of each of the at least one further roller and the longitudinal beam axis is between 3, 5 and 15 times, preferably between 5 and 10 times, the distance between the second beam side and fourth beam side.

Clause 55. Vehicle according to any of the clauses 36-54, wherein the further rail extends parallel to the beam.

Clause 56. Assembly comprising a vehicle according to any of the preceding clauses and a rail comprising a longitudinal rail axis, wherein the rollers of the vehicle engage the rail and the vehicle is movable along the rail in the direction of the longitudinal rail axis.

Clause 57. Assembly comprising a vehicle according to any of the clauses 1-56, a rail comprising a longitudinal rail axis, and a further rail, wherein the rollers of the vehicle engage the rail, the at least one further roller is in contact with the further rail, and the vehicle is movable along the rail and the further rail in the direction of the longitudinal rail axis.

Clause 58. Assembly according to clause 56 or 57, wherein the rail is made of a metallic material, such as steel, aluminium or titanium.

Clause 59. Assembly according to any of the clauses 56-58, wherein the rail has a rectangular form in a cross section perpendicular to the longitudinal rail axis and a first rail side, a second rail side, a third rail side and a fourth rail side, in which the first and third rail side extend perpendicular to the second and fourth rail side, at least two rollers are in contact with the first rail side, two rollers are in contact with the second rail side, one roller is in contact with the third rail side, and one roller is in contact with the fourth rail side.

Clause 60. Assembly comprising;

a rail having a longitudinal rail axis, a rectangular form in a cross section perpendicular to the longitudinal rail axis and a first rail side, a second rail side, a third rail side and a fourth rail side, in which the first and third rail side extend perpendicular to the second and fourth rail side, a vehicle configured to be moved along the rail and comprising rollers which engage the rail such that each roller has a contact area with which said roller is in contact with the rail, wherein at least two rollers are in contact with the first rail side, two rollers are in contact with the second rail side, one roller is in contact with the third rail side, and one roller is in contact with the fourth rail side.

Clause 61. Assembly according to any of the clauses 56-60, wherein the vehicle comprises a maximum of three rollers being in contact with the first rail side.

Clause 62. Assembly according to any of the clauses 56-60, wherein the vehicle comprises exactly two rollers being in contact with the first rail side.

Clause 63. Assembly according to any of the clauses 56-60, 62, wherein two rollers are in contact with the first rail side, said rollers are formed by a first roller and a second roller, and the first roller has one contact area which, in a direction along the first rail side and perpendicular to the longitudinal rail axis, extends over a distance from a first location to a second location.

Clause 64. Assembly according to clause 63, wherein the second roller is, a direction along the first rail side and perpendicular to the longitudinal rail axis, located between the first location and second location.

Clause 65. Assembly according to clause 64, wherein in a view in a direction perpendicular to the first rail side, a two dimensional form is defined by the first location and second location of the first roller and the contact area of the second roller.

Clause 66. Assembly according to any of the clauses 56-60, 62, wherein two rollers are in contact with the first rail side, said rollers are formed by a first roller and a second roller, and the first roller has two contact areas which, in a direction along the first rail side and perpendicular to the longitudinal rail axis, are located at a distance from each other.

Clause 67. Assembly according to clause 66, wherein the second roller is, in a direction along the first rail side and perpendicular to the longitudinal rail axis, located between the two contact areas of the first roller.

Clause 68. Assembly according to clause 67, wherein in a view in a direction perpendicular to the first rail side, a two dimensional form is defined by the three contact areas of the first roller and second roller.

Clause 69. Assembly according to any of the clauses 56-61, wherein the vehicle comprises exactly three rollers being in contact with the first rail side.

Clause 70. Assembly according to any of the clauses 56-61, 69, wherein three rollers are in contact with the first rail side and, in a view in a direction perpendicular to the first rail side, a two dimensional form is defined by the contact areas of said three rollers.

Clause 71. Assembly according to clause 70, wherein the three rollers are formed by a first roller, a second roller and a third roller, a straight line extending through the contact areas of the first roller and the third roller extends perpendicular to the longitudinal rail axis.

Clause 72. Assembly according to any of the clauses 65, 68, 70, 71, wherein the two-dimensional form is symmetric.

Clause 73. Assembly according to clause 72, wherein the symmetric two-dimensional form has an axis of symmetry, and the longitudinal rail axis, in a view in a direction perpendicular to the first rail side, overlaps the axis of symmetry.

Clause 74. Assembly according to any of the clauses 56-73, wherein the vehicle comprises exactly two rollers being in contact with the second rail side.

Clause 75. Assembly according to any of the clauses 56-74, wherein the two rollers being in contact with the second rail side are located at a distance from each other in the direction of the longitudinal rail axis.

Clause 76. Assembly according to any of the clauses 56-75, wherein the vehicle comprises exactly one roller being in contact with the third rail side.

Clause 77. Assembly according to any of the clauses 56-76, wherein the roller being in contact with the third rail side is, in a view in a direction perpendicular to the third rail side, located in the two dimensional form defined by the rollers in contact with the first rail side.

Clause 78. Assembly according to any of the clauses 56-77, wherein the vehicle comprises exactly one roller being in contact with the fourth rail side.

Clause 79. Assembly according to any of the clauses 56-78, wherein the contact area of the roller being in contact with the fourth rail side is, in the direction of the longitudinal rail axis, located between the contact areas of the two rollers being in contact with the second rail side.

Clause 80. Assembly according to any of the clauses 56-79, wherein at least one of the rollers is formed by a rollable guiding ball.

Clause 81. Assembly according to any of the clauses 56-80, wherein at least one of the rollers is formed by a guiding wheel rotatable around a wheel axis.

Clause 82. Assembly according to clause 81, wherein at least six of the rollers being in contact with the first rail side, the second rail side, the third rail side, the fourth rail side, the fifth rail side, and the sixth rail side are formed by guiding wheels, and the wheel axes of said guiding wheels do not coincide.

Clause 83. Assembly according to clause 81, wherein all of the rollers defining the first rail side, the second rail side, the third rail side, the fourth rail side, the fifth rail side, and the sixth rail side are formed by guiding wheels, and the wheel axes of said guiding wheels do not coincide.

Clause 84. Assembly according to any of the clauses 56-83, wherein the rollers being in contact with the first rail side are formed by guiding wheels and the wheel axes of said guiding wheels extend perpendicular to the second rail side and fourth rail side.

Clause 85. Assembly according to any of the clauses 56-62, 69-84, and in combination with any of the clauses 63-65, wherein the first roller is formed by a guiding wheel extending between the first location and second location.

Clause 86. Assembly according to any of the clauses 56-62, 69-84, and in combination with any of the clauses 66-68, wherein the first roller is formed by a guiding wheel extending between the two contact areas of the first roller.

Clause 87. Assembly according to any of the clauses 56-86, wherein the two rollers being in contact with the second rail side are formed by guiding wheels and the wheel axes of said guiding wheels extend perpendicular to the first rail side and third rail side.

Clause 88. Assembly according to any of the clauses 56-87, wherein the roller being in contact with the third rail side is formed by a guiding wheel and the wheel axis of said guiding wheel extends perpendicular to the second rail side and fourth rail side.

Clause 89. Assembly according to any of the clauses 56-88, wherein the roller being in contact with the fourth rail side is formed by a guiding wheel and the wheel axis of said guiding wheel extends perpendicular to the first rail side and third rail side.

Clause 90. Assembly according to any of the clauses 56-79, 81-89, wherein all the rollers are formed by a guiding wheel and the wheel axes of said guiding wheels extend parallel to the first rail side, second rail side, third rail side or fourth rail side in contact with the respective guiding wheel.

Clause 91. Assembly according to any of the clauses 81-90, wherein the guiding wheel comprises a contact surface forming the contact area and the contact surface has, in the direction of the wheel axis, an outwardly extending curve.

Clause 92. Assembly according to any of the clauses 56-62, 69-84, 87-91, and in combination with any of the clauses 63-65, 85, wherein the first roller is formed by a guiding wheel comprising a contact surface which, in the direction of the wheel axis, extends along a straight line between the first location and the second location.

Clause 93. Assembly according to any of the clauses 56-62, 69-84, 87-91, and in combination with any of the clauses 66-68, 86, wherein the first roller is formed by a guiding wheel comprising a contact surface which, in the direction of the wheel axis, has two outwardly extending curves which are located at a distance from each other and form the two contact areas.

Clause 94. Assembly according to any of the clauses 56-93, wherein the rail is made of a metallic material, such as steel, aluminium or titanium.

Clause 95. Assembly according to any of the clauses 56-94, wherein the rollers are made of metallic material, such as steel, aluminium or titanium, or a ceramic material.

Clause 96. Assembly according to clause 56-95, wherein two rollers are in contact with the first rail side, the vehicle comprises at least one further roller comprising a further contact area which is in contact with a further rail, and the further contact area is located at a distance from the rail.

Clause 97. Assembly according to clause 96, wherein the at least one further roller prevents rotation of the vehicle about the longitudinal rail axis by its contact with the further rail.

Clause 98. Assembly according to clause 96 or 97, wherein each of the at least one further roller is in contact with a surface of the further rail.

Clause 99. Assembly according to clause 98, wherein for each of the at least one further roller, the surface of the further rail with which it is in contact extends parallel to the longitudinal rail axis.

Clause 100. Assembly according to clause 98 or 99, wherein for each of the at least one further roller, the surface of the further rail with which it is in contact extends parallel to the first rail side and third rail side.

Clause 101. Assembly according to any of the clauses 96-100, wherein at least one of the at least one further roller is formed by a rollable guiding ball.

Clause 102. Assembly according to any of the clauses 96-101, wherein at least one of the at least one further roller is formed by a guiding wheel rotatable around a wheel axis.

Clause 103. Assembly according to clause 102, wherein for each guiding wheel, the wheel axis extends perpendicular to the first rail side and the third rail side, or to the second rail side and the fourth rail side.

Clause 104. Assembly according to any of the clauses 96-103, wherein the at least one further roller has a first further roller and a second further roller, the first further roller is in contact with a first surface of the further rail, and the second further roller is in contact with a second surface of the further rail.

Clause 105. Assembly according to clause 104, wherein in use the first further roller and second further roller rotate in opposite direction.

Clause 106. Assembly according to clause 104 or 105, wherein the first further roller and second further roller are formed by guiding wheels and the wheel axes of said guiding wheels extend parallel to each other.

Clause 107. Assembly according to clause 106, wherein the wheel axes of the first further roller and second further roller extend perpendicular to the second rail side and fourth rail side.

Clause 108. Assembly according to clause 106, wherein the wheel axes of the first further roller and second further roller extend perpendicular to the first rail side and third rail side.

Clause 109. Assembly according to any of the clauses 96-103, wherein the at least one further roller has a first further roller, the first further roller is in contact with a first surface of the further rail or a second surface of the further rail.

Clause 110. Assembly according to clause 109, wherein the first further roller is formed by a guiding wheel and the wheel axis of said guiding wheel extends perpendicular to the second rail side and fourth rail side.

Clause 111. Assembly according to clause 109, wherein the first further roller is formed by a guiding wheel and the wheel axes of said guiding wheel extends perpendicular to the first rail side and third rail side Clause 112. Assembly according to any of the clauses 109-111, wherein the first surface and the second surface of the further rail extend parallel to each other.

Clause 113. Assembly according to any of the clauses 96-112, wherein the distance between the further contact area of each of the at least one further roller and the longitudinal rail axis is between 3, 5 and 15 times, preferably between 5 and 10 times, the distance between the first rail side and third rail side.

Clause 114. Assembly according to any of the clauses 96-112, wherein the distance between the further contact area of each of the at least one further roller and the longitudinal rail axis is between 3, 5 and 15 times, preferably between 5 and 10 times, the distance between the second beam side and fourth beam side.

Clause 115. Assembly according to any of the clauses 96-114, wherein the further rail extends parallel to the rail.

Clause 116. Vehicle according to any of the clauses 1-35, wherein the vehicle is free from a further roller.

Clause 117. Vehicle according to any of the clauses 1-35, wherein the vehicle is free from a further roller as defined in any of the clauses 36-55.

Clause 118. Assembly according to any of the clauses 56, 58-95, wherein the assembly is free from a further roller and free from a further rail.

Clause 119. Assembly according to any of the clauses 56, 58-95, wherein the assembly is free from a further roller and further rail as defined in any of the clauses 57, 96-115.

The invention claimed is:

1. An assembly comprising:

a rail having a longitudinal rail axis, a rectangular form in a cross section perpendicular to the longitudinal rail axis and a first rail side, a second rail side, a third rail side and a fourth rail side, in which the first and third rail sides extend perpendicular to the second and fourth rail sides, a further rail, and a vehicle configured to be moved along the rail and the further rail and comprising rollers which engage the rail such that each roller has a contact area with which said roller is in contact with the rail, wherein:

exactly two rollers are in contact with the first rail side, exactly two rollers are in contact with the second rail side, exactly one roller is in contact with the third rail side, and exactly one roller is in contact with the fourth rail side, the two rollers defining the first rail side are located at a distance from each other in the direction of the longitudinal rail axis, the two rollers defining the second rail side are located at a distance from each other in the direction of the longitudinal rail axis, the contact area of the roller defining the third rail side is, in the direction of the longitudinal rail axis, located between the contact areas of the two rollers defining the first rail side, the contact area of the roller defining the fourth rail side is, in the direction of the longitudinal rail axis, located between the contact areas of the two rollers defining the second rail side, and the vehicle comprises at least one further roller comprising a further contact area which is in contact with the further rail, the further contact area is located at a distance from the rail, and the at least one further roller prevents rotation of the vehicle about the longitudinal rail axis by its contact with the further rail.

2. The vehicle according to claim 1, wherein at least one of the rollers is formed by a rollable guiding ball.

3. The assembly according to claim 1, wherein the six rollers defining the first rail side, the second rail side, the third rail side, and the fourth rail side are formed by guiding wheels, and the wheel axes of said guiding wheels do not coincide.

4. The assembly according to claim 1, wherein the rollers defining the first rail side are formed by guiding wheels and the wheel axes of said guiding wheels extend perpendicular to the second rail side and fourth rail side.

5. The assembly according to claim 1, wherein the two rollers defining the second rail side are formed by guiding wheels and the wheel axes of said guiding wheels extend perpendicular to the first rail side and third rail side.

6. The assembly according to claim 1, wherein the roller defining the third rail side is formed by a guiding wheel and the wheel axis of said guiding wheel extends perpendicular to the second rail side and fourth rail side.

7. The assembly according to claim 1, wherein the roller defining the fourth rail side is formed by a guiding wheel and the wheel axis of said guiding wheel extends perpendicular to the first rail side and third rail side.

8. The assembly according to claim 1, wherein each of the at least one further roller is in contact with a surface of the further rail and for each of the at least one further roller, the surface of the further rail with which it is in contact extends parallel to the longitudinal rail axis.

9. The assembly according to claim 8, wherein the at least one further roller has a first further roller and a second further roller, the first further roller is in contact with a first surface of the further rail, the second further roller in contact with a second surface of the further rail and in use the first further roller and second further roller rotate in opposite direction.

10. The assembly according to claim 9, wherein the first further roller and second further roller are formed by guiding wheels and the wheel axes of said guiding wheels extend parallel to each other.

11. The assembly according to claim 9, wherein the first surface and the second surface of the further rail extend parallel to each other.

* * * * *